US006174654B1

(12) United States Patent
Hagiwara et al.

(10) Patent No.: US 6,174,654 B1
(45) Date of Patent: Jan. 16, 2001

(54) METHOD FOR PROCESSING SILVER HALIDE PHOTOGRAPHIC LIGHT-SENSITIVE MATERIAL

(75) Inventors: Moeko Hagiwara; Hiroaki Kobayashi, both of Hino (JP)

(73) Assignee: Konica Corporation, Tokyo (JP)

( * ) Notice: Under 35 U.S.C. 154(b), the term of this patent shall be extended for 0 days.

(21) Appl. No.: 09/062,120

(22) Filed: Apr. 17, 1998

(30) Foreign Application Priority Data

Apr. 25, 1997 (JP) ..... 9-108898
Jun. 24, 1997 (JP) ..... 9-167563

(51) Int. Cl.[7] ..... G03C 5/29
(52) U.S. Cl. ..... 430/493; 430/434
(58) Field of Search ..... 396/584, 586, 396/587, 604, 605, 606, 608, 609; 430/434, 493

(56) References Cited

U.S. PATENT DOCUMENTS 1,927,886 * 9/1933 Burns et al. ..... 396/604
4,419,434 12/1983 Molaire et al. ..... 430/207
5,116,721 5/1992 Yamamoto ..... 430/351
5,480,628 * 1/1996 Ishikawa et al. ..... 430/493
5,687,419 * 11/1997 Earle et al. ..... 396/608
5,698,382 * 12/1997 Nakahanada et al. ..... 396/604
5,758,223 * 5/1998 Kobayashi et al. ..... 396/604

FOREIGN PATENT DOCUMENTS 0 551 757 A1 7/1993 (EP) .
0 636 930 A1 2/1995 (EP) .

OTHER PUBLICATIONS

Patent Abstracts of Japan, vol. 97, No. 8, (1997) of JP 09 090579 A.
Patent Abstracts of Japan, vol. 97, No. 7, (1997) of JP 09 080720 A.

* cited by examiner

*Primary Examiner*—Hoa Van Le
(74) *Attorney, Agent, or Firm*—Frishauf, Holtz, Goodman, Langer & Chick, P.C.

(57) ABSTRACT

A method for processing a silver halide photographic light-sensitive material is disclosed. The method comprises the step of supplying a photographic processing solution on the image forming surface of the silver halide photographic material by a processing solution supplying means, and said processing solution has a contact angle to the image forming surface of said silver halide photographic light-sensitive material of not more than 45°.

22 Claims, 12 Drawing Sheets

METHOD FOR PROCESSING SILVER HALIDE PHOTOGRAPHIC LIGHT-SENSITIVE MATERIAL

FIELD OF THE INVENTION

This invention relates to a processing method for a silver halide photographic light-sensitive material (hereinafter also referred simply to a light-sensitive material) and an automatic processor for processing the silver halide photographic light-sensitive material, particularly relates to a processing method for silver halide photographic light-sensitive material and an automatic processor to be used in the method by which a stable processing property and a rapid processing can be realized.

BACKGROUND OF THE INVENTION

In the market of photofinishing, photofinishers tend to be fragmented into small shops. A processing factory so-called a lab is rapidly on changed to mini-labs which each processes light-sensitive materials at the storefront. Recently, such the tendency is increasingly accelerated. The storefront processing is diffused to various shops such as a supermarket or a drugstore other than photo shops.

Such the trend is to meet requirements of consumers that the finished picture can be received on the same day or the processing is finished during shopping and can be received on his way home. Such the demand for a rapid processing is increasingly raised.

In addition, a processor is operated by a part-timer or layman, not professional operator, when the processing is performed in a non-professional shop or an office. Accordingly, it becomes important that the processor can be operated without feeling of the presence of a liquid and easily maintained, and that the processor is made compact from the viewpoint of the space for install of the processor.

In the processing using a processor, a replenishing system is usually applied, in which a light-sensitive material is automatically immersed in a processing tank, and a replenishing solution is replenished to the processing tank responding to the processed area of the light-sensitive material. The processing solution is overflowed by the replenishing and a steady state of running is formed. Consequently, The processing has to be controlled since the running state is varied depending on the kind of the light-sensitive material and a processed amount per day of the light-sensitive material. Therefore, a check piece so called a control strip which is a strip of light-sensitive material given a standard exposure, is developed on every day, and the processing is controlled according to the comparison of the density of the processed control strip with a standard density.

Various methods have been proposed for omitting such the complicated and professional control, in which the developing processing solution is supplied only in an amount to be used on the light-sensitive material so as to eliminate the tank. For example, Japanese Patent Publication Open for Public Inspection (JP O.P.I.) No. 2-79841 proposes a system in which the processing is performed by a processing solution absorbed in a sponge, JP O.P.I. No. 2-79844 proposes a system in which a processing solution is supplied through a slit-shaped supplying outlet, and JP O.P.I. No. 9-43814 proposes a system in which a developing processing solutions supplied through a gas phase.

SUMMARY OF THE INVENTION

A problem in these systems is that the supplied solution does uniformly penetrate into the light-sensitive material.

Particularly in the developing process, it is hard to uniformly penetrate the processing solution since the amount of the processing solution is reduced for reducing the amount of the developing solution to be brought into the next process and the amount of waste solution. Moreover, the problem of unevenness becomes serious when the processing time is reduced.

In the system in which supplying only a necessary amount of the developing solution is supplied to the light-sensitive material, the control of processing is not necessary since the new solution is supplied every time, and the amount of waste solution can be reduced by reducing the supplying amount to a small amount. However, an unevenness of the processing is caused by a slight curing of the light-sensitive material or a fine dust on the light-sensitive material when the small amount of the processing solution is supplied by coating. Particularly, a very strict control on the unevenness is necessary in the photographic processing, different from the case of coating a paint on paper, since the light-sensitive material is composed of a layer of gelatin and the processing property is controlled by diffusion of the components of the processing solution in the color forming multi-layers.

For preventing such the unevenness, a method by air blowing described in JP O.P.I. No. 2-79846 and a method of expanding the processing solution by using a porous material such as sponge described in JP O.P.I. No. 2-91645 have been proposed. However, problems of scatter of the solution or oxidation of the processing solution in the porous material are raised, which are demanded to be solved.

Consequently, the first object of the invention is to provide a method for processing a silver halide photographic light-sensitive material using an automatic processor by which the processing can stably be performed by an easy control. The second object of the invention is to provide a method for processing a silver halide photographic light-sensitive material using an automatic processor by which the processing can stably be performed when the amount of processing is small, and the third object of the invention is to provide a method for processing a silver halide photographic light-sensitive material using an automatic processor by which a rapid processing can be realized and waste liquid amount can be reduced for reducing the environmental load.

The above-mentioned objects can be attained by a method for processing a silver halide photographic light-sensitive material comprising the step of supplying a photographic processing solution having a contact angle to said image forming surface of the silver halide photographic light-sensitive material of not more than 45° on the image forming surface of the silver halide photographic material by a processing solution supplying means.

BRIEF DESCRIPTION OF THE DRAWINGS

FIG. 15(*b*) shows the principle of the measurement.

DETAILED DESCRIPTION OF THE INVENTION

The inventors has been found that the formation of the unevenness can be prevented and the rapid processing can be realized by supplying a processing solution which has a contact angle to the light-sensitive material of not more than 45° at the time of supplying by an automatic processor having a processing solution supplying means.

Usually it is desirable that the solution to be coated has a certain high viscosity and contact angle for realizing a stable coating since a bead of the solution is suitably formed. In the invention, however, the bead is stabilized at a contact angle of not more than 45°, such the effect cannot be expected at all.

Such the effect considerably appears in the developing solution, particularly in a rapid processing, which is sensible to the unevenness. In the case of the developing solution, it is particularly effective to control the contact angle within the range of from 20° to 40°, and to coat the solution by the coating means.

Moreover, an unexpected effect that the ability of rapid processing is further accelerated can be obtained when the technique of the invention is applied.

The invention is characterized in that the processing solution having a contact angle to the light-sensitive material of not more than 45° at the time of supplying to the light-sensitive material. The contact angle is a contact angle between the light-sensitive material and the processing solution at the time of supplying of the processing solution to the light-sensitive material. The contact angle is measured by the "liquid drop method" described in "Shin Jikken Kagaku Kouza (New Course of the Experimental Chemistry), No. 18 Interface of Colloid" p. 97.

Figure 15:
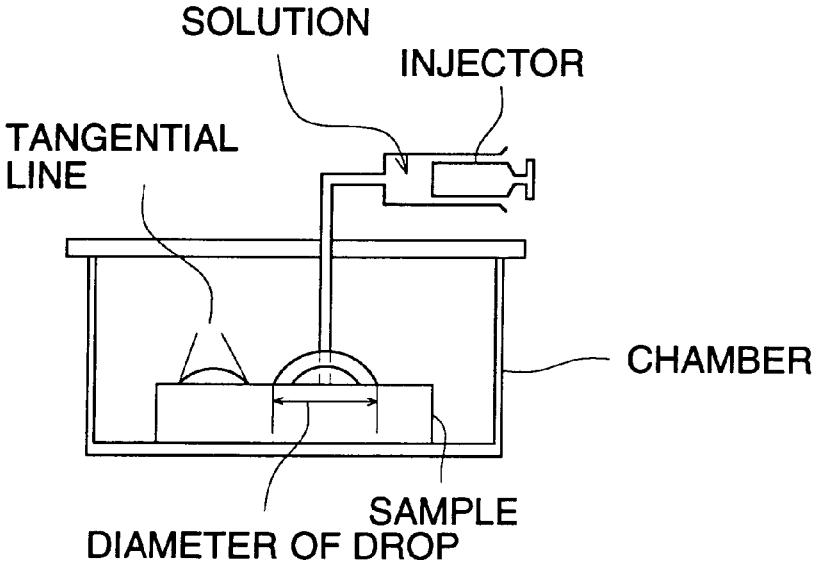
FIG. 15(*a*) shows a drawing explaining the measuring method of the contact angle.
Figure 15:
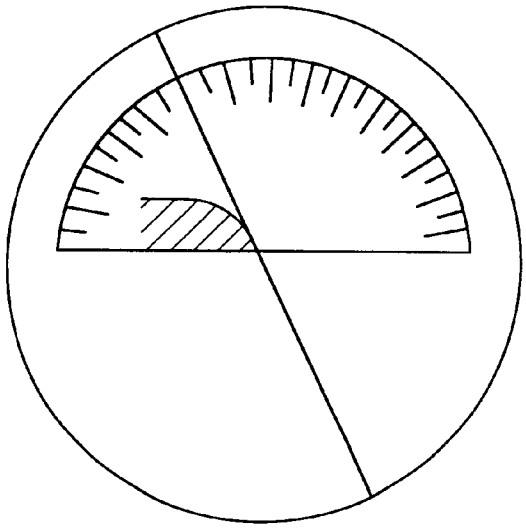

The contact angle of the light-sensitive material to the processing solution is measured according to the contact angle measuring method described in "Shin Jikken Kagaku Kouza (New Course of the Experimental Chemistry) Vol. 18, Surface and Colloid" p. 97, published by Maruzen in Oct. 20, 1977, using a flat sheet sample of the light-sensitive material to be processed. The sheet of the sample is horizontally stood in a chamber filled by vapor of the liquid to be measured as shown in FIG. 15(*a*), and a drop of the liquid is formed on the surface of the sample using an injector. The size of the drop is controlled so as to be not more than 3 mm in the contacting diameter, it is reported that the drop volume of not more than 0.1 $cm^3$ is allowable. The contact angle can be measured by a reading microscope having a magnitude of about 20 times equipped with a protractor. FIG. 15(*b*) shows the principle of the measurement. The liquid is lighted by parallel right come from the front side through a white turbid glass or a heat absorbing glass. The accuracy of the measurement is ±1° which can be reduced to ±0.5° by experience. The angles of the right and left sides of the drop are measured, and the measured results of the drop are renounced. The angle is further measured after increasing the volume of drop or standing for certain time for checking the variation of the angle. The measurement is carried out at several points on the same surface of sample. At least 10 data are measured and the average value of them are calculated. Distilled water is used as water to be used in the measurement. In the invention, the contact angle of the processing solution to the light-sensitive material or coating roller is defined by the contact angle measured under the condition in which the temperature of the light-sensitive material or the material of the coating roller and that of the processing solution are adjusted to those at the processing time.

The contact angle can be controlled by addition of a surfactant to the processing solution, variation of the temperature of the solution or light-sensitive material, preferably the temperature of light-sensitive material, or variation of the surface property of light-sensitive material. As the surfactant to be added to the processing solution, usual surfactants having a surface activity are usable without any limitation. A silicone surfactant or a fluorine-containing surfactant is preferably used for adjusting the contact angle to that of the invention. A polyether-modified siloxane type surfactant is preferable as the silicone surfactant, and a perfluoroalkyl type surfactant is preferable as the fluorine-containing surfactant. The surfactant may be used singly or in combination of two ore more kinds thereof.

At least one compound selected from compounds represented by the following Formula I, SI or SII and water-soluble siloxane compounds is preferably contained in the processing solution according to the invention.

$$Rf\text{-}(X)_m\text{-}(Y)_n\text{-}A \qquad \text{Formula [I]}$$

In the formula, Rf is a saturated or unsaturated hydrocarbon group having at least one fluorine atom, and X is a sulfonamido group,

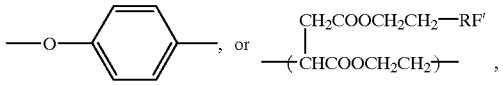

and Y is an alkylene oxide group. Rf' is a saturated or unsaturated hydrocarbon group, preferably an alkyl group having 4 to 12 carbon atoms, more preferably 6 to 9 carbon atoms, which has at least one fluorine atom. A represents a hydrophilic group such as —$SO_3M$, —$OSO_3M$, —COOM, —$OPO_3(M_1)$ $(M_2)$ and —$PO_3(M_1)$ $(M_2)$, and —$SO_3$ is preferable. M, $M_1$, and $M_2$ are each H, Li, K, Na, or $NH_4$, among them Li, K and Na are preferable and Li is most preferable. m represents 0 or 1, and n represents 0 or an integer of 1 to 10, and m and n are preferably 0.

$$R^1X(E^1)_{l_1}\text{-}(E^2)_{m_1}\text{-}(E^3)_{n_1}R^2 \qquad \text{Formula SI}$$

In the formula, $R^1$ is a hydrogen atom, an aliphatic group or an acyl group, $R^2$ is a hydrogen atom, or an aliphatic group. $E^1$ is an ethylene oxide group, $E^2$ is a propylene oxide group, and $E^3$ is an ethylene oxide group, X is an oxygen atom, or a —$R^3$N— group in which $R^3$ is an aliphatic group, a hydrogen atom or $-(E^1)_{l_2}-(E^2)_{m_2}-(E^3)_{n_2}R^4$. $l_1$, $l_2$, $m_1$, $m_2$, $n_1$, and $n_2$ are each an integer of 0 to 300.

$$A_2—O-(B)_m-(C)_n-X_1 \qquad \text{Formula SII}$$

In the formula, $A_2$ is a mono-valent organic group, for example an alkyl group having 6 to 50 carbon atoms, preferably 6 to 35 carbon atoms, such as a hexyl group, a heptyl group, octyl group, a nonyl group, a decyl group, an undecyl group or a dodecyl group, or an aryl group substituted by an alkyl group having 3 to 35 carbon atoms or by an alkenyl group having 2 to 35 carbon atoms.

Preferable substituents of the aryl group include an alkyl group having 1 to 18 carbon atoms, for example, an unsubstituted alkyl group such as a butyl group, a pentyl group, a hexyl group, a heptyl group, an octyl group, a nonyl group, a decyl group, an undecyl group, or dodecyl group, a substituted alkyl group such as a benzyl group or a phenetyl group, and an alkenyl group having 2 to 20 carbon atoms, for example, an unsubstituted alkenyl group such as an oleyl group, a cetyl group or an allyl group, or a substituted alkenyl group such as a styryl group. As the aryl group, a phenyl group, a biphenyl group and a naphthyl group, preferably a phenyl group, are cited. The position of the aryl group at which a substituent is bonded may be any of ortho-, metha- and para-position. The aryl group may be substituted by plural substituents.

B and C are each an ethylene oxide group, a propylene oxide group, or $$-(CH_2)_{n_1}-(\underset{\underset{OH}{|}}{CH})_{m_1}-(CH_2)_{l_1}-O-,$$

in which $n_1$, $m_1$, and $l_1$, are each 0, 1, 2, or 3. m and n are each an integer of 0 to 100. $X_1$ is a hydrogen atom, an alkyl group, an aralkyl group, or an aryl group.

Compounds represented by the following Formula SU-1 are preferred as the water-soluble siloxane compound.

Formula SU-I

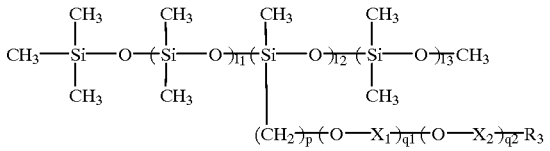

In the formula, $R_3$ is a hydrogen atom, a hydroxyl group, a lower alkyl group, an alkoxyl group,

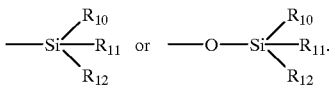

$R_{10}$, $R_{11}$, and $R_{12}$ are each a hydrogen atom, or a lower alkyl group, $R_{10}$, $R_{11}$, and $R_{12}$ may be the same or different. $l_1$, $l_2$ and $l_3$ are each an integer of 0 to 30 and p, $q_1$ and $q_2$ are each 0 or an integer of 1 to 30.

$X_1$ and $X_2$ are each $$—CH_2CH_2—,\ —CH_2CH_2CH_2—,$$

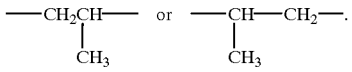

Concrete examples are described in JP O.P.I. No. 4-299340. Particularly preferable examples are shown below.

$C_8F_{17}SO_3K$ I-1

$C_8F_{17}SO_3Li$ I-2

$C_8F_{17}COONH_4$ I-3

$C_8F_{17}COOK$ I-4

I-5

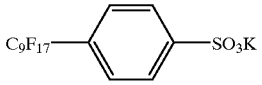

I-5

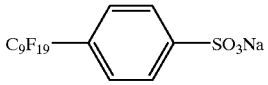

I-6

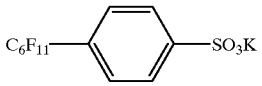

I-7

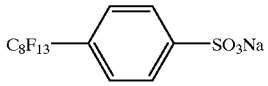

$C_7F_{15}CONHC_2H_4NC_5H_4Cl$ I-8

$C_7H_{15}COONH_4$ I-9

I-10

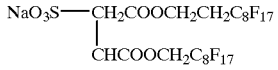

I-11

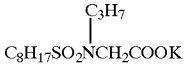

I-12

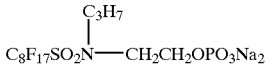

I-13

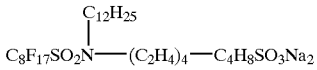

Among the compounds represented by Formula I, Compounds I-1, I-2, I-4 and I-8 are preferred.

These compounds can be synthesized by ordinary method and are available on the market.

Compounds represented by Formula SI $C_{12}H_{25}COO-(C_2H_4O)_{10}H$ SI-1

$C_9H_{18}COO-(C_2H_4O)_4H$ SI-2

$C_{12}H_{25}NH(C_2H_4O)_{10}H$ SI-3

$C_{12}H_{25}NH(C_2H_4O)_{15}H$ SI-4

$HO(C_2H_4O)_{20}(CH(CH_3)CH_2O)_5(C_2H_4O)_{20}H$ SI-5

$C_{12}H_{25}NHCH_2CH_2OH$ SI-6

$C_{12}H_{25}N(CH_2CH_2O)_{10}H(CH_2CH_2O)_{10}H$ SI-7

$HO(CH(CH_3)CH_2O)_{30.2}(CH_2CH_2O)_{159.1}H$ SI-8

Compound represented by Formula SII $C_{12}H_{25}O(C_2H_4O)_{10}H$ SII-1

$C_8H_{17}O(C_3H_6O)_{15}H$ SII-2

$C_9H_{18}O(C_2H_4O)_4H$ SII-3

$C_{10}H_{21}O(C_2H_4O)_{15}H$ SII-4 [001b]

SII-5

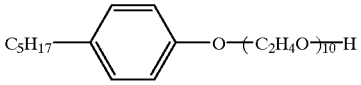

SII-6

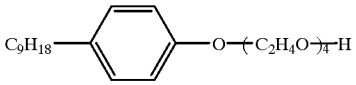

SII-7

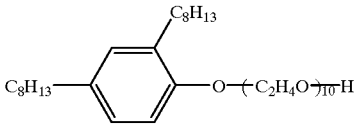

SII-8

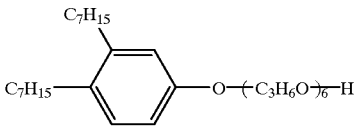

SII-9

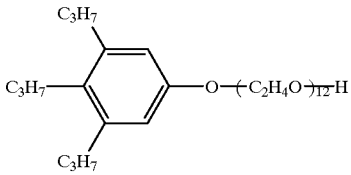

SII-10

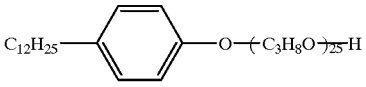

-continued

SII-11

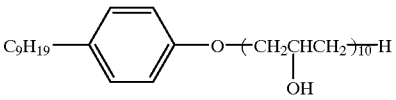

Water-soluble siloxane compounds

SU-I-1

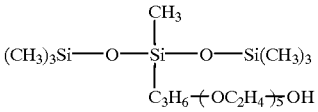

SU-I-2

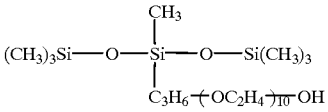

SU-I-3

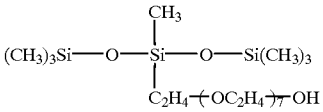

SU-I-4

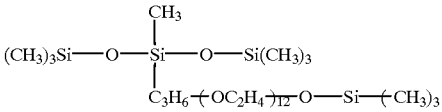

SU-I-5

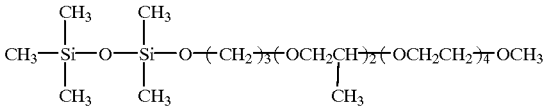

SU-I-6

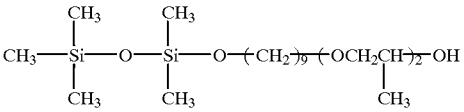

SU-I-7

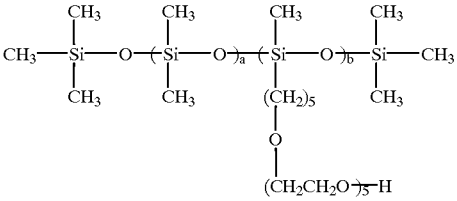

a + b + 30

The temperature of the processing solution is raised when it is possible. The temperature of the light-sensitive material to be processed is preferably not less than 40° C., more preferably within the range of from 45° C. to 95° C., further preferably within the range of from 50° C. to 90° C. The raising of the temperature of the light-sensitive material is preferable to the control of the solution from the view point of the operation. Accordingly, is preferred that a heating means for heating the light-sensitive material to 40° C. or more at a position in or before the developing process.

A contact heating means for heating the light-sensitive material by heat conduction such as heating roller, a heating drum, or a heating belt, and a convection heating means for heating the light-sensitive material by the convection of hot air such as a dryer, and a radiation heating means for heating by infrared rays or high frequency electromagnetic radiation, are usable.

It is preferred that the automatic processor to be used in the method of the invention has a heating controlling means which controls the heating means so that the heating means is operated only when the light-sensitive material exists at the position where the light-sensitive material is to be heated. Such the operation can be performed by controlling the heating means synchronously with the detection signal from a detecting means for detecting the presence of the light-sensitive material. The detecting means is provided at the position of upper stream of the transportation direction of the light-sensitive material transporting means in which the light-sensitive material is transported at a prescribed speed. Further, it is also preferable to provide a means for maintaining the temperature of the light-sensitive material after supplying the processing solution thereon. The temperature of the light-sensitive material is preferably maintained at 40° C. or more until the light-sensitive material is contacted to the processing solution of the next process. It is preferable that the amount of the developing processing solution is small so as to maintain the temperature of the light-sensitive material at such the high temperature.

In the invention, when the light-sensitive material is heated before the supply of the developing solution on the emulsion surface, it is preferred that the heating is carried out after the light-sensitive material has been exposed to light to reduce the influence of the changing of the photographic properties of the light-sensitive material caused by difference of the temperature at the time of the exposure to light.

In the invention, it is preferable that the coating amount of the developing solution is controlled within the range of from 5 to 100 ml, more preferably from 10 to 60 ml, further preferably from 15 to 50 ml, per square meter of the light-sensitive material. When the processing solution is composed of two or more component solutions, the coating amount is the total amount of these solutions.

The surface property of the light-sensitive material may be controlled by known means.

A coating means is preferred as the processing solution supplying means. The coating means in the invention is a means for supplying a prescribed amount of the processing solution on the surface of the light-sensitive material, and a method in which the light-sensitive material is immersed in a tank filled by the solution to penetrate the composition of the solution into the light-sensitive material from the bulk solution is not included in the supplying means of the invention.

The concrete coating means can be roughly divided into a system in which the solution is supplied by splaying or through a gas phase, and a system in which the solution is supplied by coating through a tool such as a roller or directly supplied by curtain coating.

As the system supplying through gas phase, a method got scattering droplet of the solution using the vibration of a piezoelectric element such as a piezo-type ink-jet head or a thermal head using bumping, and a splay method in which the solution is splayed by pressure of air or a liquid, are usable.

As the method of coating through a tool or directly coating, an air doctor coater, a blade coater, a rod coater, a knife coater, a squeeze coater, an immersing coater, a reverse coater, a transfer coater, a curtain coater, a double roller coater, a slide hopper, a gravure coater, a kiss-roller coater, a bead coater, a cast coater, a spray coater, a calender coater and a extruding coater are usable.

The effects of the invention can be more effectively enhanced in the method by the supplying through the tool or directly supplying compared with the method through a gas phase. The methods each using the squeeze roller, gravure coater, immersing coater, bead coater, blade coater and the coater using a coating roller are preferred. Among such the coating means, one which is not directly contacted to the light-sensitive material is preferred. A type of the bead coater of which coating roller is not directly contacted to the light-sensitive material is particularly preferable. It is preferred in such the type of bead coater that the processing solution is supplied through a nozzle or a slit to form a bead and the bead is contacted to the light-sensitive material. In the case of roller coater, it is preferred to previously coat the processing solution on the coating roller and to coat the processing solution on the light-sensitive material from the coating roller without directly contacting the roller to the light-sensitive material.

When the coating roller is used for supplying the processing solution to the light-sensitive material, the coating roller is rotated in the direction of the transportation of the light-sensitive material so as to coat the processing solution onto the image forming surface of the light-sensitive material. In such the case, the processing solution is supplied to the light-sensitive material by the coating roller contacted with the light-sensitive material, or positioned so as to leave a space corresponding to the thickness of the layer of the processing solution to be supplied.

The contact angle of the processing solution to the coating roller is 5° to 50°, and the angle is preferably 10° to 40°, more preferably 20° to 30°, from the viewpoint of that the processing solution can be made uniform on the coating roller. The coating roller is preferably a metal roller such as one made by SUS. Concretely, stainless steel such as SUS316L, SUS316, SUS304 and SUS303, titanium (Ti) and brass (Bs) are preferred. When a roller made by a plastics or elastic Teflon is used, the roller is preferably coated by a surfactant so as to lower the contact angle. A coating roller having a hydrophilic material is also preferred. One laminated with 6-Nylon, N-methoxymethylpolyamide, polyurethane or polyacetal is also preferred. The preferable surfactant to be coated on the roller is one capable of being oriented to the hydrophobic roller so that the hydrophilic group is directed to the surface. Accordingly, it is preferred to coat an ampholytic surfactant or a ethylene oxide compound.

The contact angle of the roller to the processing solution can be measured by a method similar to the foregoing method for measuring the contact angle to the light-sensitive material.

The processing solution is supplied to the coating roller through a processing solution supplying means. The processing solution supplying means supplies the processing solution to the coating roller through the solution supplying outlet. The distance between the outlet and the coating roller is 0.2 mm to 10 mm, preferably 0.5 mm to 7 mm, more preferably 1 mm to 4 mm. Such the distance is preferred since a prescribed amount of processing solution can be supplied to the coating roller through the solution supplying outlet without disorder of the solution. It is preferable that the solution flowing distance on the coating roller from the solution supplying outlet until the solution is coated on the light-sensitive material, is set up to 5 mm to 50 mm, from the viewpoint of avoidance of air oxidation or evaporation of the processing solution. The distance is preferably 7 to 40 mm, more preferably 10 to 30 mm.

The amount of the processing solution supplied from the solution supplying outlet to the coating roller is 5 ml to 100 ml, preferably 10 ml to 60 ml, more preferably 15 ml to 50 ml, per $m^2$. Such the amount of the processing solution is preferred so that the optimal amount of processing solution is supplied on the coating roller.

The automatic processor preferably has a removing means for removing the processing solution remained on the coating roller after supplying the processing solution. Mixing of an impurity to the processing solution to be newly coated can be avoided by removing the processing solution remaining on the coating roller.

In the invention, it is preferred that the processing solution to be supplied composed of to or more component solutions. In such the case, the effects of the invention can be sufficiently enhanced since a highly concentrated solution can be temporarily formed by mixing plural concentrated solutions on the surface of the light-sensitive material. Such the high concentration of the solution is hardly attained when the solution is prepared in a form of one solution. In concrete, it is preferred that the processing solution is at least composed of a first partial solution containing a developing agent and a second partial solution containing an alkaline component. Consequently, at least a first supplying means for the first partial solution and a second supplying means for the second partial solution are provided in the automatic processor of the invention. As the developing agent, a black-and-white developing agent such as hydroquinone, methol, phenidone, and a color developing agent such as a p-phenylene diamine derivative and a hydrazine derivative are usable. The effects of the invention is enhanced when the color developing agent is used.

The p-phenylenediamine derivative, particularly one having a water-solubilizing group, is preferred as the color developing agent.

The developing agent can be rapidly supplied to the lower layer of the silver halide photographic light-sensitive material by separately coating the two partial solutions. In detail, diffusion of the color developing agent into the emulsion layer of the light-sensitive material is hardly accelerated by raising the concentration incline of the color developing agent in the emulsion layer since the solubility of the color developing agent in the color developer is generally low. Furthermore, the reaction in the lower layer is delayed since the color developing agent having a lower diffusibility is consumed in the upper and medium layers. It has been difficult to make rapid the processing by ht e above-mentioned two reasons. The above-mentioned difficulty can be solved by the continuous coating of the two partial solutions and the rapid processing can be realized.

Further, problem such as formation of tarry substance or becoming dirty of the solution by air oxidation of the developer during the storage or standing the solution, can also be reduced by the use of the two partial solutions.

In the invention, the "partial solution" means a solution in which one or more compounds constituting the color developer are separately dissolved, and an ordinary developing solution or simple water may be used as the "partial solution".

The supplying ratio of one partial solution to another partial solution of the color developer is preferably not less than 0.01 and not more than 100, more preferably not less than 0.1 and not more than 10, most preferably not less than 0.5 and not more than 2.

The time for supplying all of the color developing solutions is preferably within the first ⅔, more preferably within ⅓, most preferably within 1/10, of the period of the color developing process.

It is preferable that the color developing agent relating to the invention has a solubilizing group. The p-phenylenediamine compound has at least one solubilizing group at the amino group or the benzene ring thereof. As preferable example of the solubilizing group, $-(CH_2)_n-CH_2OH$, $-(CH_2)_m-NHSO_2-(CH_2)_n-CH_3$, $-(CH_2)_m-O-(CH_2)_n-CH_3$, $-(CH_2CH_2O)_n-C_mH_{2m+1}$, in which m and n represent each an integer of 0 or more, —COOH and $—SO_3H$ are cited.

The supplying amount of the color developing solutions is preferably in proportion to the exposure amount to the light-sensitive material.

Preferably supplying order of the color developing solutions are shown below:

(1) Developing agent containing partial solution→Alkaline agent containing partial solution (2) Developing agent containing partial solution→Alkaline agent containing partial solution and developing agent containing partial solution (3) Water→Developing agent containing partial solution→Alkaline agent containing partial solution (4) Water→Developing agent containing partial solution→Alkaline agent containing partial solution and developing agent containing partial solution (5) Alkaline agent containing partial solution→Developing agent containing partial solution (6) Alkaline agent containing partial solution and developing agent containing partial solution→Developing agent containing partial solution (7) Water→Alkaline agent containing partial solution→Developing agent containing partial solution (8) Water→Alkaline agent containing partial solution and developing agent containing partial solution→Developing agent containing partial solution Among the above-mentioned order, (1), (2), (3), and (4) are preferable and (1) and (3) are most preferable.

Concrete examples of paraphenylenediamine compound preferably usable in the invention are shown below.

C-1

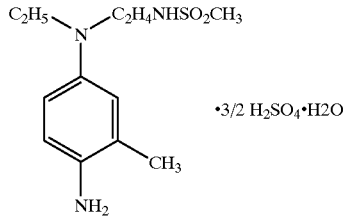

C-2

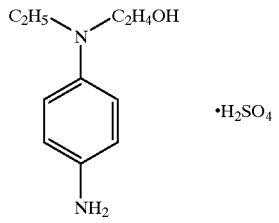

C-3

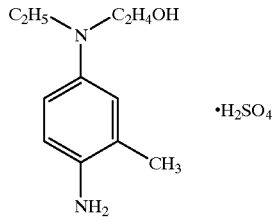

-continued
C-4
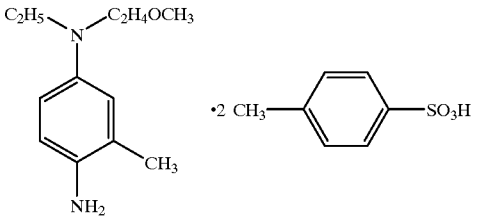
C-5
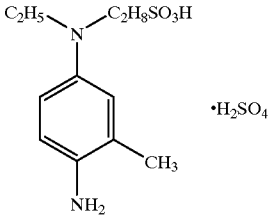
C-6
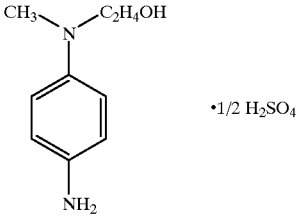
C-7
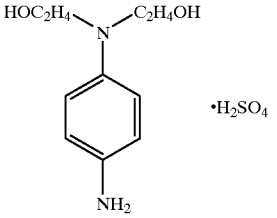
C-8
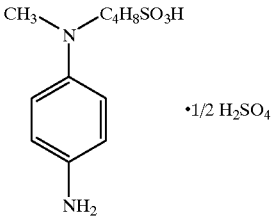
C-9
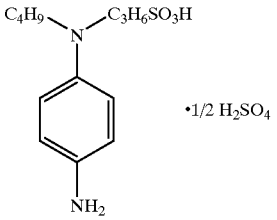
-continued
C-10
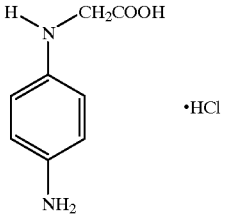
C-11
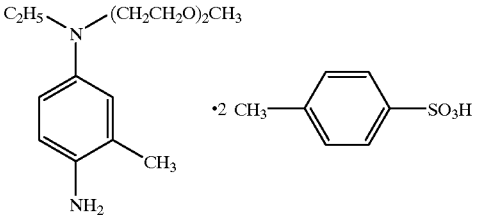
C-12
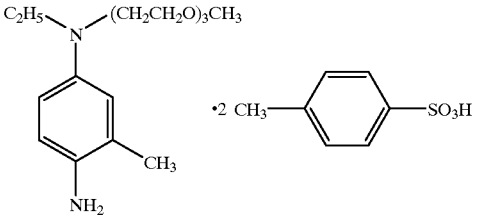
C-13
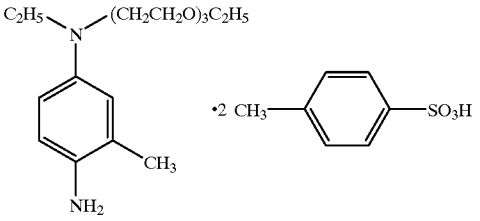
C-14
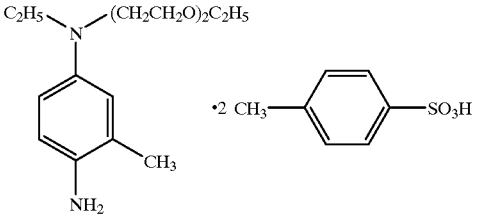
C-15
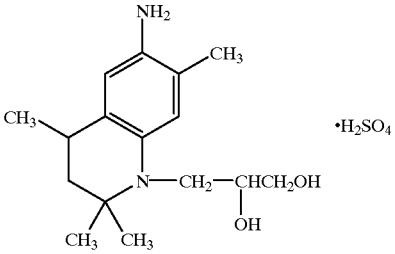

-continued

C-16

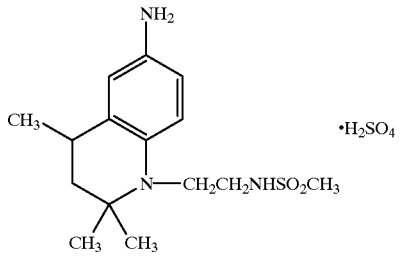

Among the above-shown color developing agents, C-1, C-2, C-3, C-4, C-6, C-7 and C-15 are preferred, and C-3 is particularly preferred. The above-mentioned para-phenylenediamine compound is usually used in a form of hydrochloride, sulfate or p-toluenesulfonate. These compounds are usually used in a form of hydrochloride, sulfate or p-toluenesulfonate. The using amount of the color developing agent is usually from 10 to 150 g, preferably from 10 to 100 g, more preferably from 15 to 70 g, per liter of the total of the developing partial solutions usually supplied.

As the black-and-white developing agent, phenidone, 4-hydroxymethyl-4-methyl-1-phenyl-3-pyrazolidone, methol, ascorbic acid and hydroquinone are usable.

The first partial solution may further contain a surfactant, a solubilizing agent for developing agent, and a preservative. The second partial solution may contain a surfactant, a solubilizing agent for developing agent, a preservative and a chelating agent.

As the solubilizing agent for developing agent, triethanolamine, a polyethylene glycol, and paratouenesulfonic acid described in JP O.P.I. No. 7-10769 are usable. The solubilizing agent is usually used in an amount of from 1 to 100 g, preferably 5 to 80 g, more preferably 10 to 50 g, per liter of the total of the developing partial solutions usually supplied.

In the invention, the alkaline component is one giving a pH value not less than 8.0 when 7.0 g of the component is dissolved in pure water and finished to 1 liter, and is preferably an alkali metal compound such as potassium carbonate, sodium carbonate, sodium bicarbonate, potassium bicarbonate, trisodium phosphate, tripotassium phosphate, dipotassium phosphate, sodium borate, potassium borate, sodium tetraborate or borax, potassium tetraborate, potassium hydroxide, sodium hydroxide, and lithium hydroxide are usable. Among them, sodium carbonate, sodium bicarbonate, trisodium phosphate and sodium borate are preferred, and sodium carbonate is particularly preferred. The alkaline component is usually used in an amount of from 10 to 300 g, preferably 10 to 150 g, more preferably 20 to 100 g, per liter of the total of the developing processing solutions usually supplied.

As the preservative, sodium sulfite, hydroxylamine, and hydroxylamines described on pages 9 through 13 of JP O.P.I. No. 8-29924 are usable.

It is preferred that the silver halide photographic light-sensitive material is arrived at the next process within a time of not more than 20 seconds, more preferably from 3 to 15 seconds, particularly from 5 to 12 seconds after the supply of the developing solution. The effects of the invention is satisfactorily enhanced when the developing process is performed within the rang e of from 2 to 15 seconds, and the developing solution is supplied for not more than 5 seconds in total. "Arrived at next process" means that the light-sensitive material is contacted to the processing solution of the next process.

The light-sensitive material to be processed includes a silver halide color photographic light-sensitive material having an emulsion layer containing silver halide having an average silver chloride content of not less than 80 mole-%, a silver halide color photographic light-sensitive material containing a silver iodobromide or silver bromide emulsion, a monochromatic light-sensitive material, and a silver halide photographic light-sensitive material for X-ray photography having emulsion layers on the both surfaces of the support.

EXAMPLES

Example 1

In the Example, tests were carried out using ten kinds of processors according to Embodiment 1 to 10 of the invention. A scheme of construction of an example of automatic processor according to the invention is given in FIG. 1.

The automatic processor shown in the figure is composed of a developing process in which a heating means 10, developing means 40 and a second heating means are provided along the transporting course of the light-sensitive material P, a bleach-fixing tank BF, a stabilizing tank ST and a drying process Dry. In the heating means 10, a pressing belt 15 is put over an entrance roller 13, an exit roller 12 and a pressing roller driving roller 14, and the light-sensitive material P is transported and heated while being pressed to a heating drum 11 on a section of 90° of the surface of the drum. A developing means 40 which is provided at a lower stream position in the light-sensitive material transporting course than that of the heating drum 11, has a processing solution receptacle 43 accommodating the first solution, Partial solution 1 or Sol-1, a processing solution receptacle 46 accommodating the second solution, Partial solution 2 or Sol-2, processing solution supplying means 42 and 45 for supplying each of the solutions, for example, a spiral-type gravure roll having a lateral pitch of 80 lines/inch which is rotated to transporting direction at a speed of 100 r.p.m., and rollers 41 and 45 facing to each other. The processing means 40 supplies the color developing solution to the emulsion surface of the light-sensitive material heated by the heating means 10. In this example, the second partial solution is supplied 1.0 seconds after the supply of the first partial solution. A second heating means is composed of a heating roller 31, a driving roller 32 and a heating belt 33 put over these rollers. The light-sensitive material P, on the emulsion surface of which the processing solutions have been supplied by the processing solution supplying means 42 and 45, is heated by heating belt 33 which is heated by heating roller 31. The heating belt may have many holes to contact to the light-sensitive material P by sucking from the back side of the belt by a fun or an air compressor.

Then the light-sensitive material P is bleach-fixed in the bleach-fixing tank BF, stabilized in the stabilizing tank ST and dried in the drying process Dry.

Figure 1:
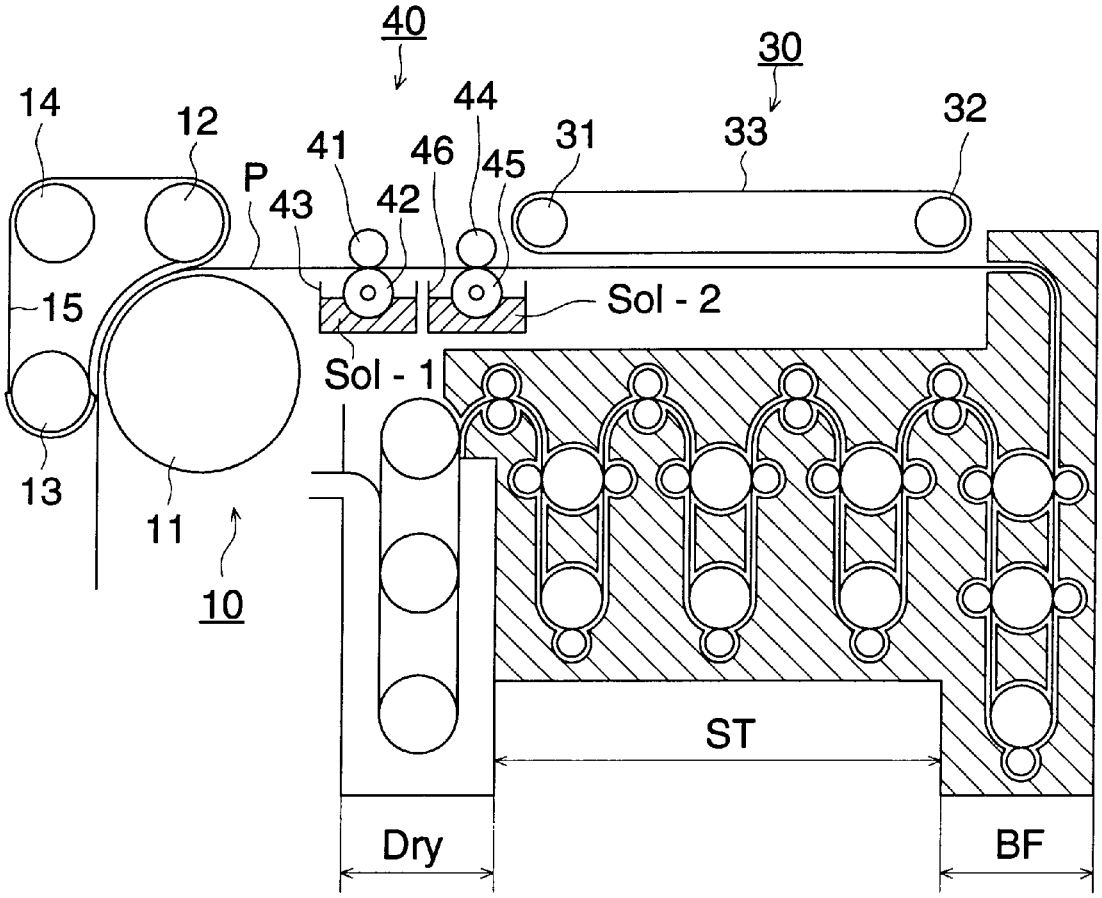
FIG. 1 shows the schematic construction of an example of automatic processor having roller coaters according to the invention.

In this example, the processor shown in FIG. 1 is referred to Embodiment 2. In other embodiments, the kind of the processing solution supplying means 42 and 45 were changed and the contact angle of the solution at the time of supplying, the temperature of the light-sensitive material by heating at the time of supplying the developing solution, the period between the start of the supply of the developing processing solution and the time at which the light-sensitive material was immersed into the bleach-fixing tank, and the supplying amount of the developing processing solution were changed as shown in Table 1, and the processing property and the formation of unevenness were evaluated.

Figure 2:
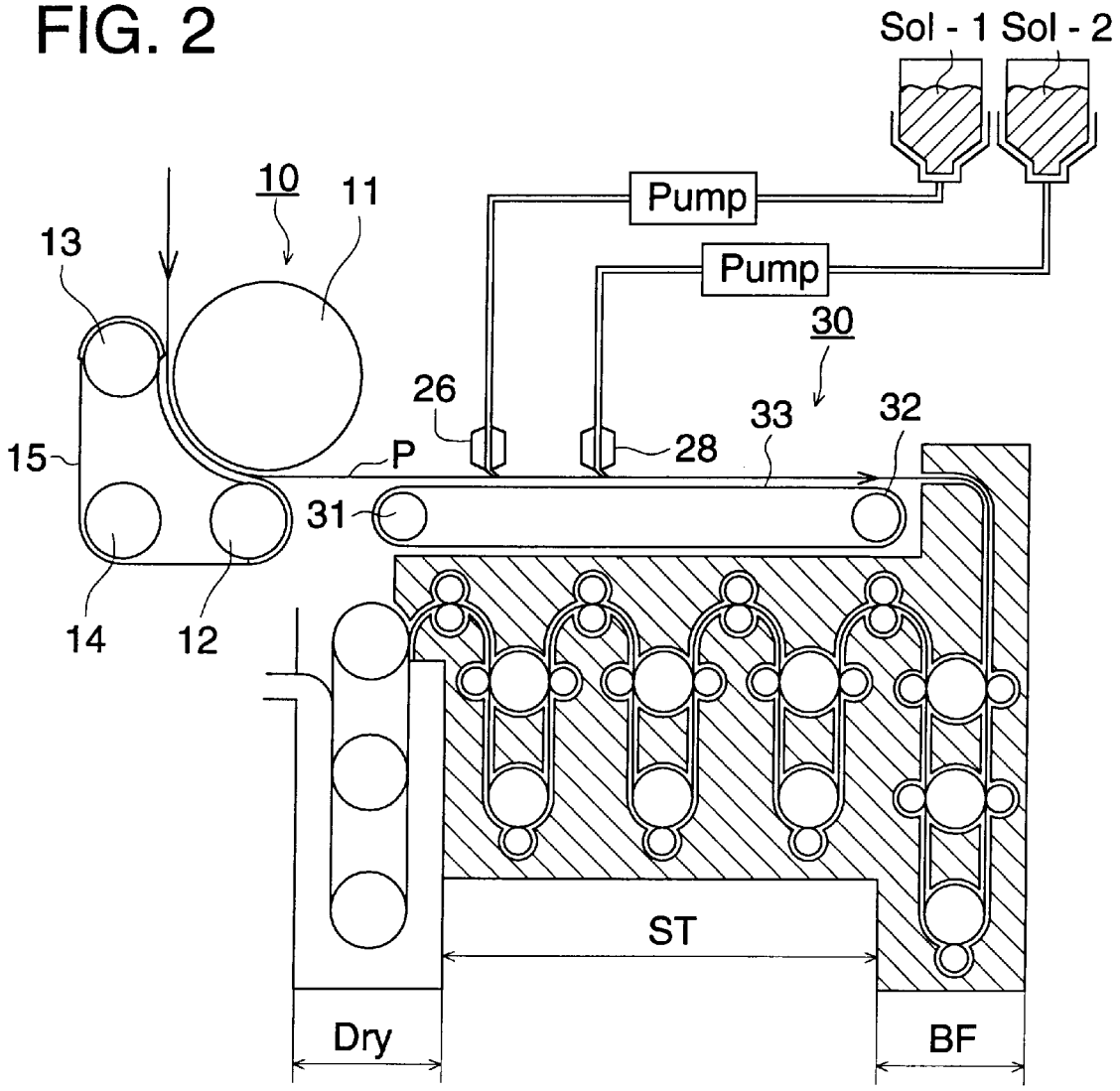
FIG. 2 shows another example of automatic processor having extrusion coaters to be used in the method of the invention.
Figure 3:
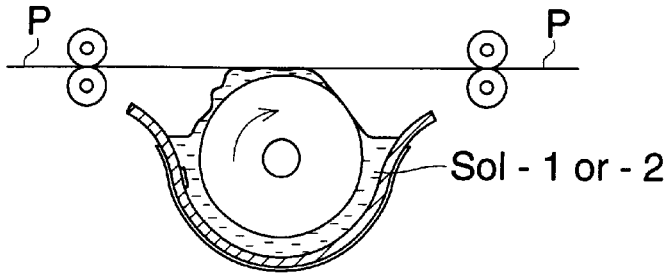
FIG. 3 shows the coater used in the automatic processor shown in FIG. 1.
Figure 4:
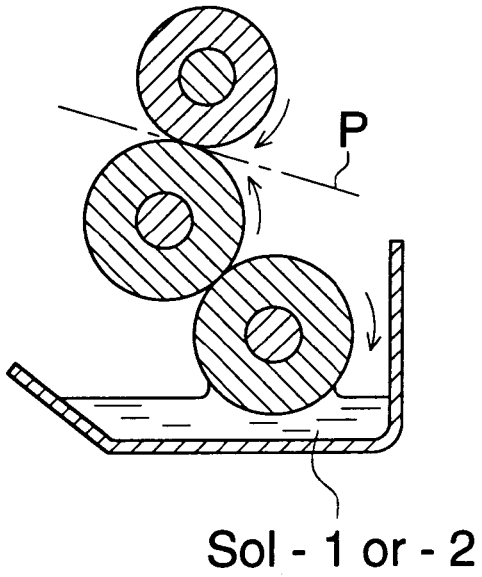
FIG. 4 shows a processing solution supplying means using a transfer roller coater.
Figure 5:
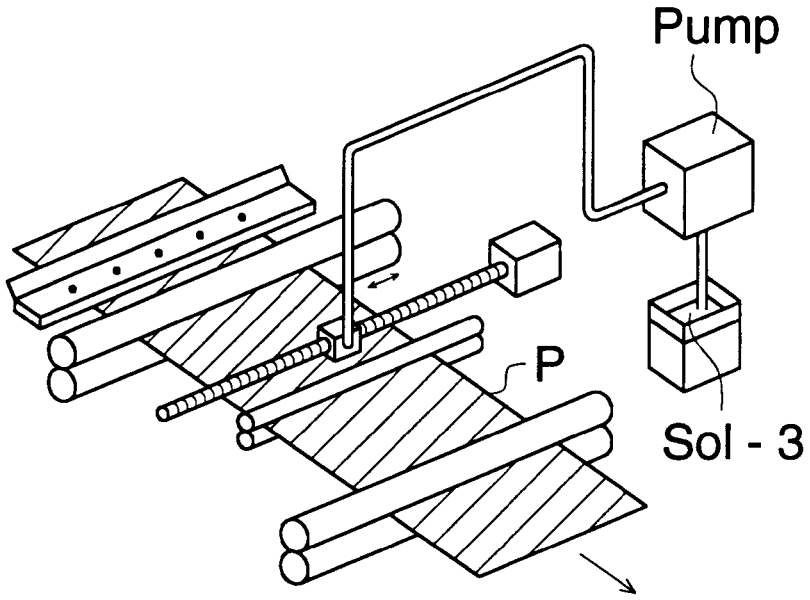
FIG. 5 shows another type processing solution supplying means.
Figure 6:
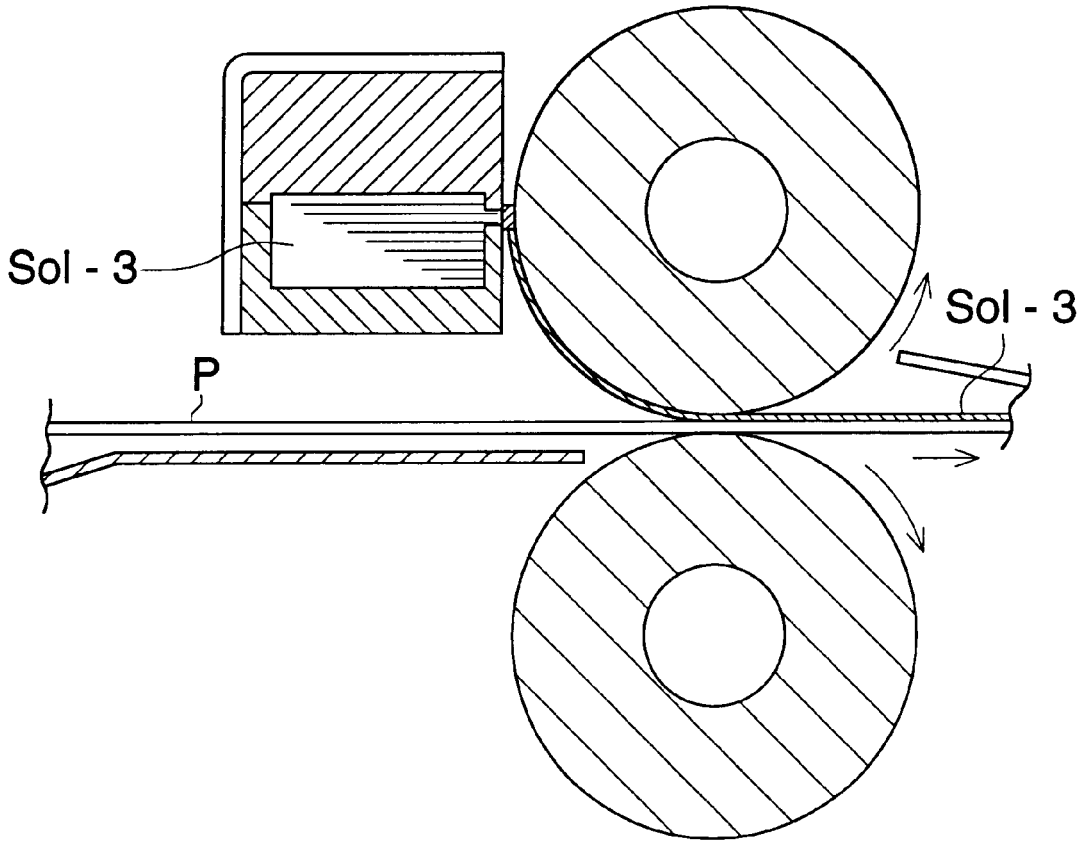
FIG. 6 shows another processing solution supplying means for single processing solution using a roller coater.
Figure 7:
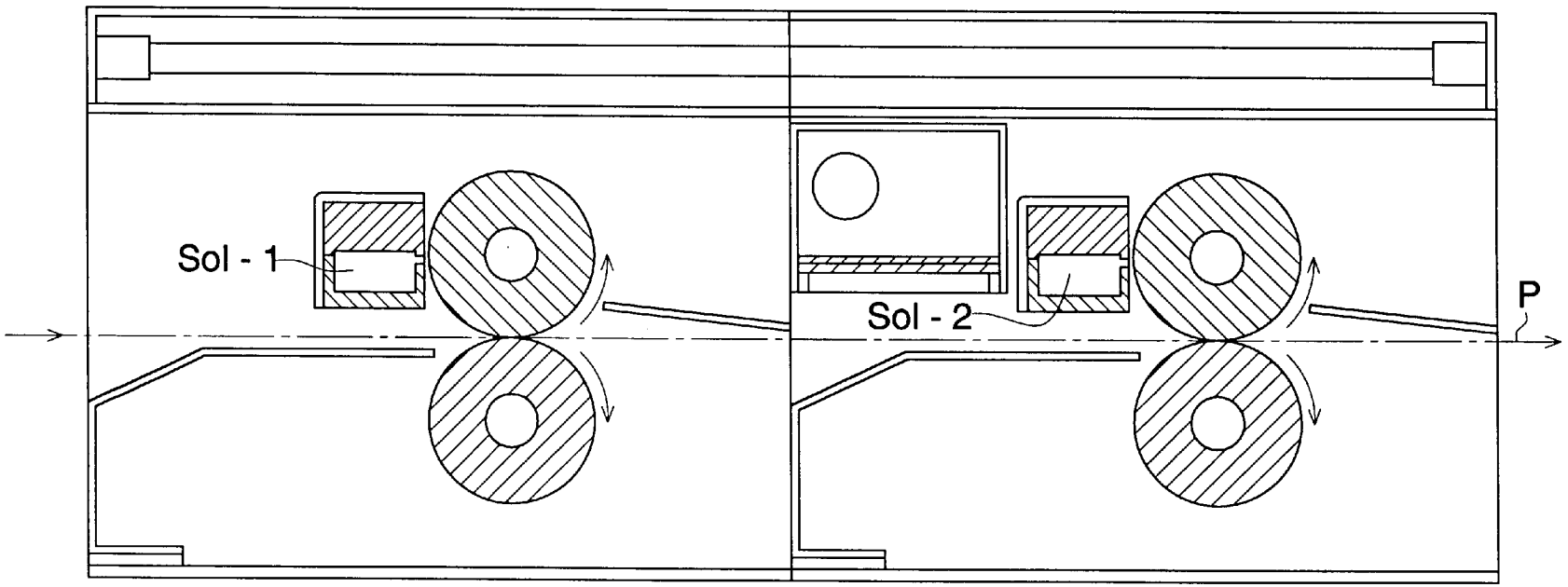
FIG. 7 shows another processing solution supplying means using two roller coaters.
Figure 8:
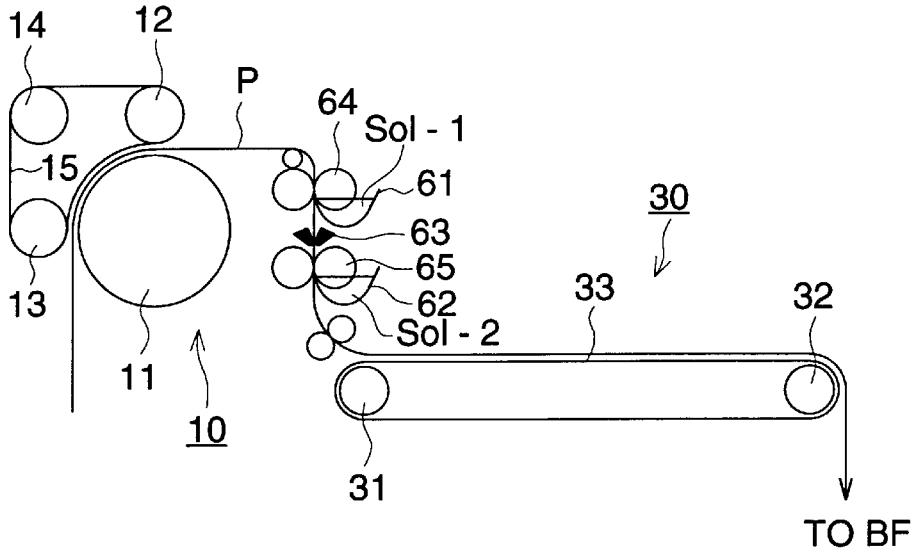
FIG. 8 shows another example of automatic processor using two gravure roller coaters according to the invention.
Figure 9:
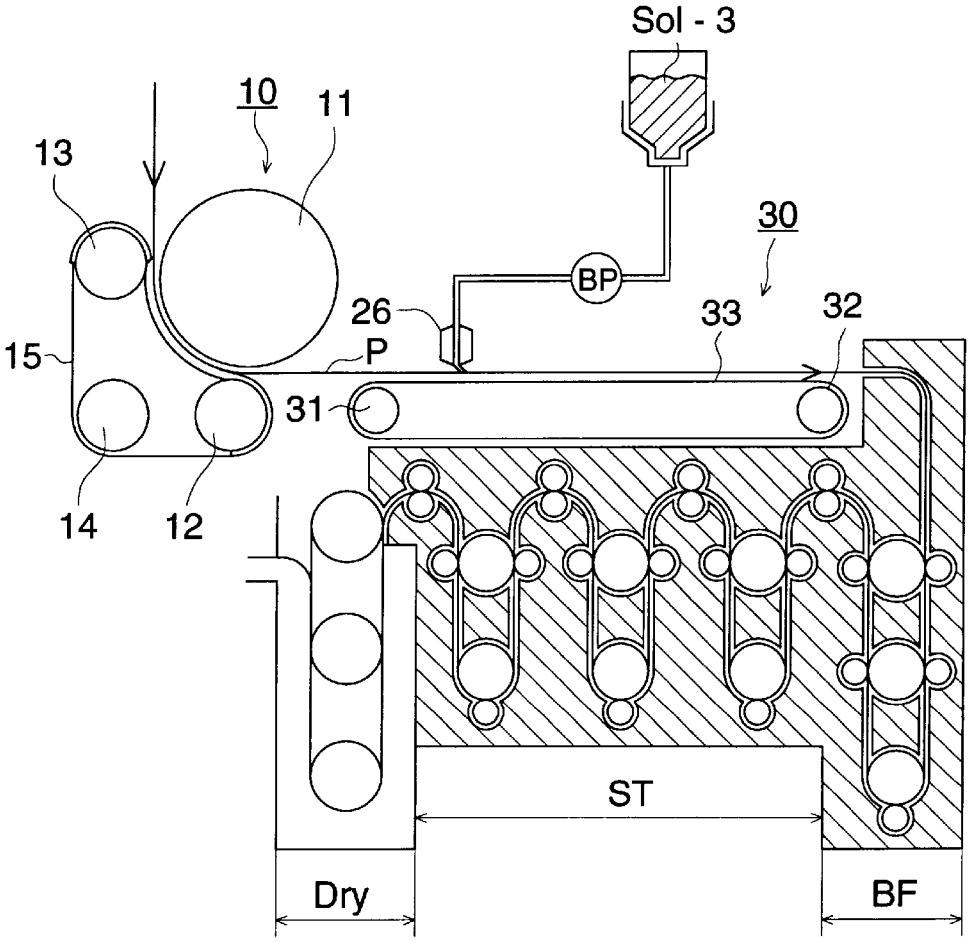
FIG. 9 shows another example of automatic processor having a extrusion coater.
Figure 10:
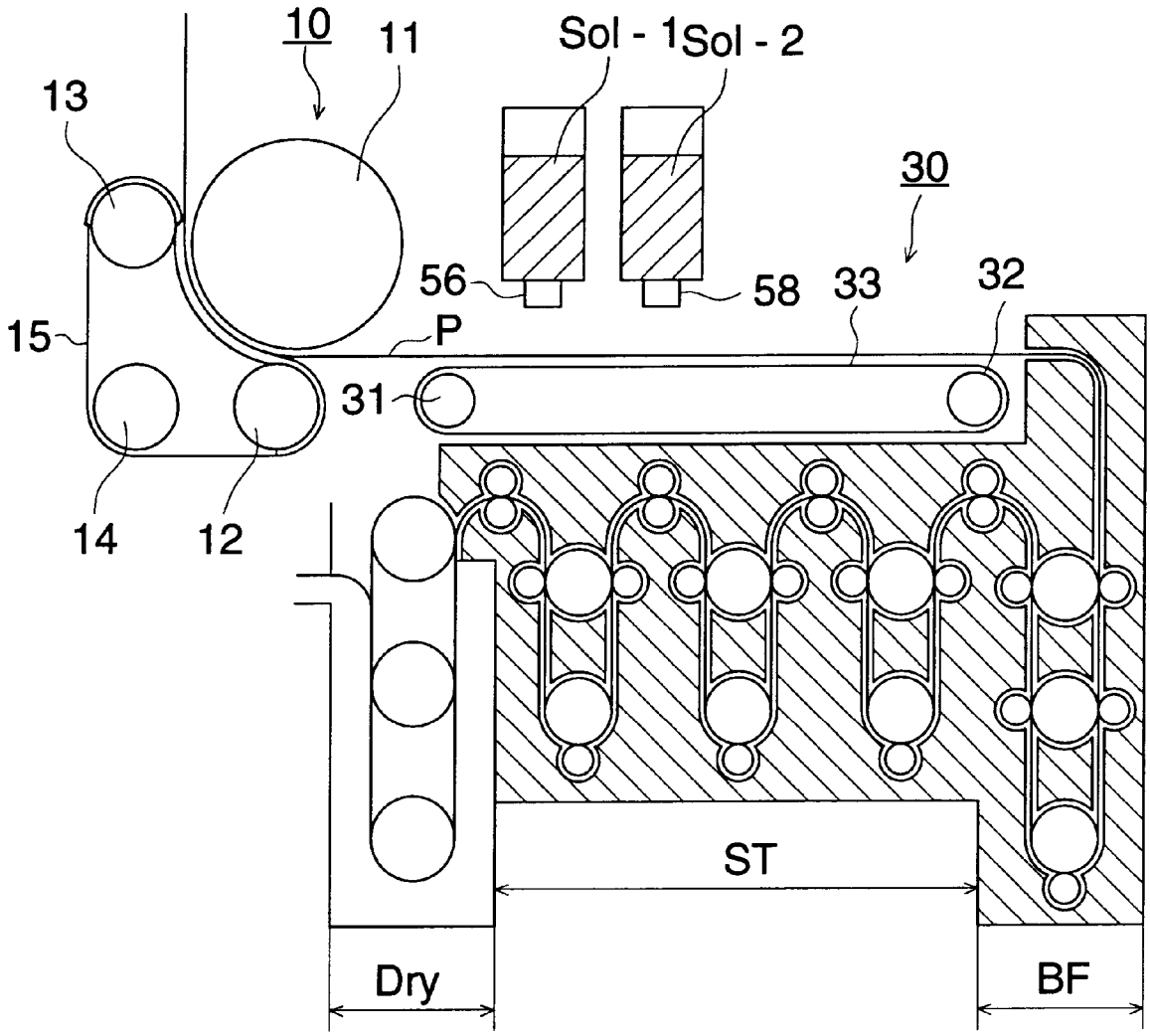
FIG. 10 shows the developing process of an automatic processor having two ink-jet heads as the processing solution supplying means.

In Embodiment 1, extrusion coaters 26 and 28 shown in FIG. 2 are used as the processing solution supplying means. Embodiment 3, a coater shown in FIG. 3 is used in place of the processing solution supplying means 42 and 45. In Embodiment 4, a transfer-roller coater shown in FIG. 4 is used. In Embodiments 5, 6, and 7, coaters shown in FIGS. 5, 6 and 7 are, respectively. In Embodiment 8, a gravure coater shown in FIG. 8 is used. In this embodiment, the processing solutions 1 and 2 are coated on the light-sensitive material using gravure coating roller 64 and 62, respectively. In FIG. 8, 61 and 62 are the coating pans each filled by the processing solution 1 and 2, respectively, and 63 is a squeezer. Embodiment 9 is the same as Embodiment 1 except that a single processing solution, Solution 3 or Sol-3, is supplied from the extrusion coater 26 as shown in FIG. 9. Embodiment 10 is the same as Embodiment 1 except that a piezoelectric ink-jet head coaters 56 and 58 are used in place of the extrusion coaters as shown in FIG. 10. Solutions 1 and 2 are supplied to the light-sensitive material from the ink-jet heads through gas phase or air phase. Solution 2 is supplied at 0.5 seconds after the supply of Solution 1. In this embodiment, the nozzles of the ink-jet supplying head is lines parallel with the transporting direction of the light-sensitive material P. The nozzles are arranged as two staggered lines. The distance between the nozzles and the diameter of nozzle are 150 $\mu$m and 90 $\mu$m, respectively.

The solution used in Embodiments 5, 6 and 9 is the single developing solution, Solution 3 or Sol-3.

Unexposed Color paper QA-$A_6$, manufactured by Konica Corporation, having a width of 29.7 cm was processed for 30 days in a rate of 0.8 $m^2$ per day using the first partial solution and the second partial solution, or a single solution, Solution 3, which is a mixture of Solution 1 and Solution 2. For bleach-fixing and stabilizing processes, processing compositions and conditions according to CPK-2-J1 Process of Konica Corporation was applied. Then a control strip of the QA-$A_6$ Color Paper was processed for measuring the maximum density measured by blue light $D_{max}$(B) and for visually observing the formation of unevenness. The unevenness was evaluated according to the following norm.

<Receipt of developing processing solution>

Partial Solution 1

| | |
|---|---|
| Sodium sulfite | 0.2 g |
| Cinopal SFP (manufactured by Ciba-Geigy) | 2.0 g |
| p-toluenesufonic acid | 10.0 g |
| 4-amino-3-methyl-N-ethyl-N-[β-(methanesulfonamido)ethyl]aniline sulfate | 40.0 g |
| Surfactant* | |
| Pure water to make | 1 l |

The pH of the solution was adjusted to 2.0 using potassium hydroxide or sulfuric acid.

Partial Solution 2

| | |
|---|---|
| Pentasodium diethylenetriaminepantaacetate | 5.0 g |
| Potassium carbonate | 70 g |
| p-toluenesulfonic acid | 10 g |
| Surfactant* | |
| Pure water make to | 1 l |

The pH of the solution was adjusted to 13.0 using potassium hydroxide.

Solution 3

Solution 3 was prepared by mixing the first solution and the second solution. The pH of the solution was adjusted to 10.5 using potassium hydroxide or sulfuric acid.

As Surfactant*, sodium perfluorooctylsulfonate and perfluorooctylamine oxide was used, and the mixing ratio thereof was changed to control the contact angle.

<Norm for evaluation>

A: Unevenness was not formed.

B: Some degree of unevenness was formed. However, any problem was not raised on practical use.

C: Unevenness was formed. The level of the unevenness was so high to raise a problem on the photographic property.

CC: Considerable unevenness was formed.

Results are shown in Table 1.

TABLE 1

| Experiment No. | Embodiment of processor | Contact angle | Temperature of color paper | Processing time | Supplying amount ml/$m^2$ Sol-1 | Sol-2 | Unevenness | $D_{max}$ (B) |
|---|---|---|---|---|---|---|---|---|
| 1-1 | 1 | 60° | 60° C. | 10" | 20 | 20 | CC | 1.75 |
| 1-2 | 1 | 50° | 60° C. | 10" | 20 | 20 | CC | 1.78 |
| 1-3 | 1 | 45° | 60° C. | 10" | 20 | 20 | A | 2.23 |
| 1-4 | 1 | 40° | Not heated | 10" | 20 | 20 | A | 2.25 |
| 1-5 | 1 | 30° | 60° C. | 10" | 20 | 20 | A | 2.26 |
| 1-6 | 1 | 40° | 60° C. | 5" | 20 | 20 | A | 2.08 |
| 1-7 | 1 | 40° | 60° C. | 15" | 20 | 20 | A | 2.25 |
| 1-8 | 1 | 40° | 60° C. | 20" | 20 | 20 | A | 2.23 |
| 1-9 | 1 | 40° | 60° C. | 30" | 20 | 20 | B | 2.20 |
| 1-10 | 1 | 40° | 60° C. | 10" | 100 | 20 | B | 1.98 |
| 1-11 | 1 | 40° | 60° C. | 10" | 20 | 100 | B | 1.95 |
| 1-12 | 1 | 40° | 60° C. | 10" | 60 | 60 | B | 1.85 |
| 1-13 | 1 | 40° | 60° C. | 10" | 50 | 50 | A | 2.02 |
| 1-14 | 2 | 40° | 60° C. | 10" | 20 | 20 | A | 2.25 |
| 1-15 | 3 | 40° | 60° C. | 10" | 20 | 20 | A | 2.24 |
| 1-16 | 4 | 40° | 60° C. | 10" | 20 | 20 | A | 2.24 |
| 1-17 | 5 | 40° | 60° C. | 10" | Sol-3 | 40 | B | 1.98 |
| 1-18 | 6 | 40° | 60° C. | 10" | Sol-3 | 40 | A | 2.01 |
| 1-19 | 7 | 40° | 60° C. | 15" | 20 | 20 | A | 2.25 |

TABLE 1-continued

| Experiment No. | Embodiment of processor | Contact angle | Temperature of color paper | Processing time | Supplying amount ml/m² Sol-1 | Supplying amount ml/m² Sol-2 | Unevenness | $D_{max}$ (B) |
|---|---|---|---|---|---|---|---|---|
| 1-20 | 8 | 40° | 60° C. | 10" | 20 | 20 | A | 2.25 |
| 1-21 | 9 | 40° | 60° C. | 10" | Sol-3 | 40 | A | 2.18 |
| 1-22 | 9 | 40° | 60° C. | 15" | Sol-3 | 40 | A | 2.21 |
| 1-23 | 10 | 40° | 60° C. | 10" | 20 | 20 | B | 1.98 |

It is understood from the above-listed results that the formation of the unevenness is avoided and the density can be stably obtained by controlling the contact angle to not more than 45°. T he formation the unevenness is inhibited and the effect on the rapid processing is enhanced by heating the light-sensitive material. Moreover, it is found that the effects of the invention is satisfactory enhanced even when the total supplying amount of the developing processing solution is reduced to not more than 100 ml/m², or not more than 50 ml/m².

Example 2

An embodiment of the automatic processor using a coating roller is described in detail below according to figures. In this embodiment, although the developing process of the automatic processor for light-sensitive material is described, the embodiment can be applied also to another process such as a fixing process or a washing process.

Figure 11:
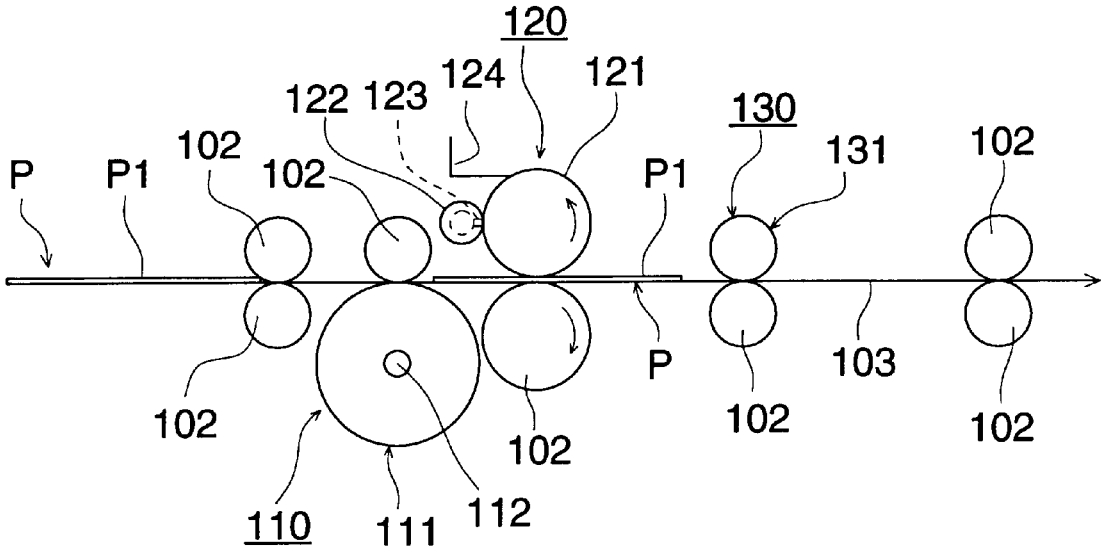
FIG. 11 shows a construction of a developing process of an automatic processor according to the invention.
Figure 12:
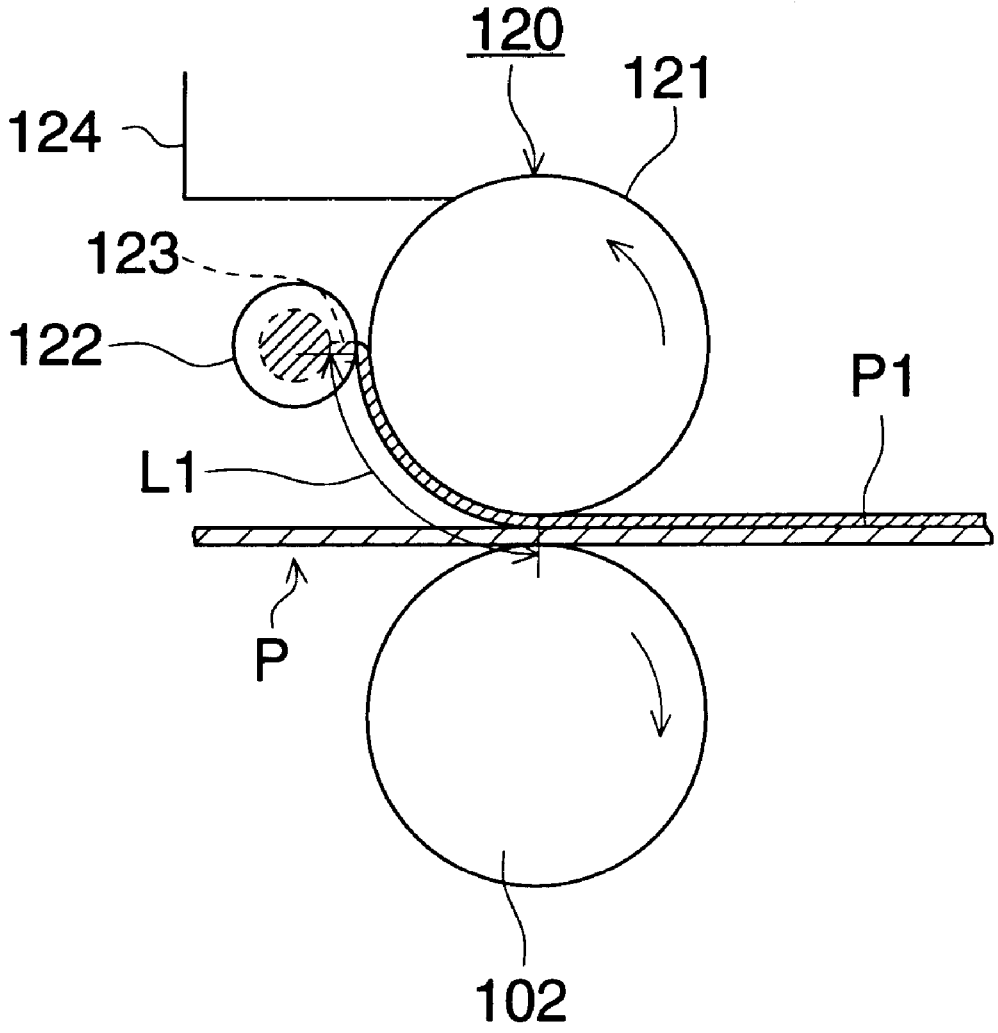
FIG. 12 shows an enlarged view of the coating solution supplying portion of the processor shown in FIG. 11.

FIG. 11 shows the schematic constitution of the developing process of an automatic processor for the light-sensitive material, and FIG. 12 shows an enlarged view of the coating supplying portion. In the developing process of the automatic processor, a transporting course 103 is formed by plural rollers 102, through which a light-sensitive material P is transported. The transporting course 103 is formed in the horizontal direction. The silver halide photographic light-sensitive material P is cut in a form of sheet before input to the developing process, and is transported in the position so that the image forming surface P1 is faced upward. On the transporting course 103 of the silver halide photographic light-sensitive material, a preheating portion 110, a coating supplying portion 120, and a squeezing portion are equipped in this order along the transporting direction of the light-sensitive material.

In the preheating portion, a transporting roller 102 is arranged at the upper side of the transporting course and a heating roller 111 is arranged at the lower stream of the transporting course facing to the transporting roller 102. A heater 112 is built in the heat roller 111, and the heat roller 11 constitutes the heating means for heating the silver halide photographic light-sensitive material P. The silver halide photographic light-sensitive material P is heated at 45° C. to 95° C., preferably 50° C. to 90° C., more preferably 60° C. to 80° C., for enhancing the effect of the invention.

In the coating supplying portion 20, a coating roller 121 for coating the processing solution on the image forming surface P1 of the silver halide photographic light-sensitive material P, and a processing solution supplying means 122 for supplying the processing solution to the coating roller 121. The coating roller 121 is rotated in the transporting direction at a speed almost the same as the transporting speed of the silver halide photographic light-sensitive material P. The contact angel of the processing solution with the coating roller 121 is set within the range of from 5° to 50° C. Thus the processing solution can be uniformly coated on the image forming surface P1 of the silver halide photographic light-sensitive material P, and a high quality processing with out unevenness of processing can be realized. The thickness of the coating layer is become too thin when the contact angle smaller than the foregoing range, and the thickness is become too thick when the contact angle is larger than that of the range. A coating layer having a sufficient uniformity and an appropriate thickness can be obtained when the contact angle is set within the range of 5° to 50°.

The processing solution supplying means 122 has a solution supplying outlet 123, and the distance between the processing solution supplying outlet 123 and the coating roller 121 is 0.2 mm to 10 mm. A prescribed amount of the processing solution can be supplied through the solution supplying outlet without disorder of flow of the solution when the distance is within this range. The flow of the solution on the coating solution is disordered by the supplying pressure when the distance is smaller than the foregoing range When the distance is larger than the foregoing range, the supply of the processing solution is become unstable and the flow of the solution is disordered.

The supplying amount of the processing solution from the solution supplying outlet 123 to the coating roller 121 is set within the range of from 5 ml to 100 ml per m². The supplying amount is shorten when the supplying amount is smaller than the above-mentioned range, and the processing solution is uselessly consumed. An optimal amount of the processing solution can be supplied by setting the supplying amount of the solution within the range of 5 ml to 100 ml per m².

The flowing distance L1 of the processing solution on the coating roller 121, from the outlet 123 until the solution coated to the silver halide photographic light-sensitive material P, is set within the range of 5 mm to 50 mm. Thus the processing solution supplied on the coating roller 121 is made uniform so that the processing solution can be uniformly coated on the image forming surface P1 of the silver halide photographic light-sensitive material P. Then a high quality processing with no unevenness of processing can be realized. When the flowing distance of the solution on the coating roller 121 is smaller than the above-mentioned range, the processing solution is coated on the image forming surface P1 of the silver halide photographic light-sensitive material P before the solution is not uniformed yet, and when the flowing distance L1 is shorter than the above-mentioned range, the processing solution is degraded by oxidation.

The processor further equipped with a solution removing means 124 for removing the processing solution remained on the coating roller 121 after supplying the coating. The solution removing means 124 is constituted by a blade which is contacted to the coating roller to remove the remained processing solution. Thus the mixing of an impurity into the processing solution to be newly coated can be avoided.

In the squeezing portion 130, squeezing rollers 131 are equipped at the upper and lower portion of the transporting course 103 so as to facing with together. It is allowed that at least the upper rollers to be contacted to the image forming surface P1 of the silver halide photographic light-sensitive material P is a squeeze roller. In such the case, a transporting roller 102 is used as the lower roller. The squeeze roller is arrange at a lower stream of the transportation of the light-sensitive material, and makes uniform the developer supplied on the light-sensitive material P by squeezing.

A water absorbing sponge roller is usually used as the squeezing roller. In the invention, however, a roller having a low water absorbing ability is preferred. As the squeezing roller, the followings are preferred: a metal roller, a plastics roller, a rubber roller, a cloth roller, a non-woven fabric cloth roller, and a sintered roller. As the metal roller, a roller of stainless steel such as SUS316L, SUS316, SUS304 and SUS303, aluminum (Al), Titanium (Ti), and brass (Bs) are preferred. As the material of the plastics squeeze roller, that made by polyethylene terephthalate (PET), polyethylene (PE), Copolymer resin of tetrafluoroethylene/perfluoroalkoxyethylen (PFA), polyacetal (POM), polypropylene (PP), polytetrafluoroethylene (PTEF), polyvinyl chloride (PVC), phenol resin (PF), modified polyphenylene ether (PPE), modified polyphenylene oxide (PPO), polyurethane (PU), polycarbonate (PC), polyphenylene sulfide (PPS), polyfluorovinylidene (PVDF), copolymer resin of tetrafluoroethylene/hexafluoropropylene (FEP), or copolymer resin of tetrafluoroethylene/ethylene (ETFE) is preferred. As the rubber roller, a roller of ethylenepropylene rubber (EPDM, EPM), silicone rubber (Si), nitryl rubber or chloroprene rubber is preferred. As the material of the cloth and non-woven fabric cloth, polyolefin fiber, polyester fiber, polyacrylonitryl fiber, aliphatic polyamide fiber, aromatic polyamide fiber or polyphenylene sulfide fiber is preferred. A roller coated with Teflon is more preferable.

Figure 13:
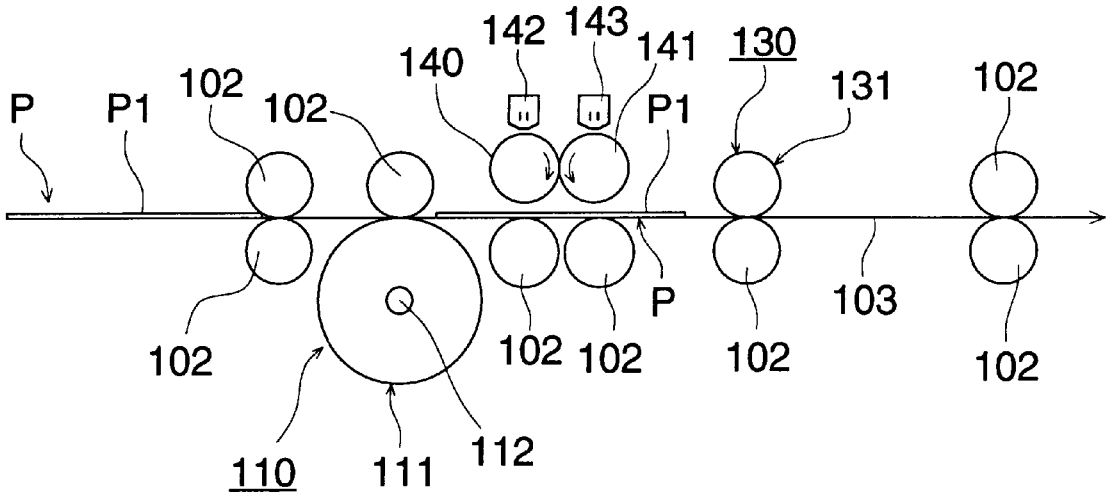
FIG. 13 shows a constitution of the developing process of another automatic processor according to the invention.

Although the processing solution supplied to the developing process of the processor shown in FIGS. 10 and 11 is a single solution developer, when the developer is composed of at least two partial solutions, a partial solution containing a color developing agent and a partial solution containing an alkaline agent, the developing process of the automatic processor for the light-sensitive material is constituted as shown in schematic constitution drawing of FIGS. 12 and 13. In this embodiment, the same elements as those in FIG. 1 are indicated by the same number in FIG. 10 and description on their is omitted.

Figure 14:
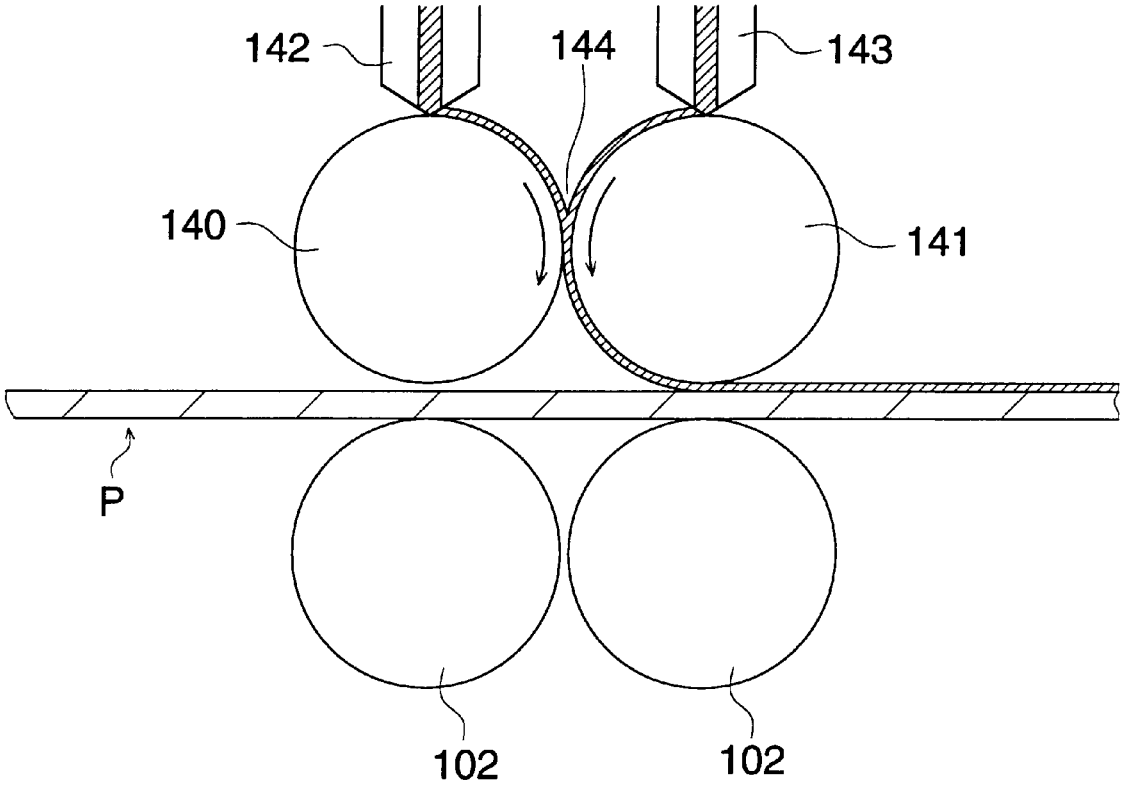
FIG. 14 shows an enlarged view of the coating solution supplying portion of the processor shown in FIG. 13.

FIG. 13 shows the schematic constitution of another embodiment, and FIG. 14 shows a enlarged view of the coating supplying portion. The processor has a pair of processing solution supplying means, 142 and 143. and a pair of coating rollers 140 and 141, are arranged The partial developing solutions are supplied from the supplying means 142 and 143 on the rollers 140 and 141, respectively. The coating rollers 140 and 141, are arranged so to make the distance L between the supplying points. The rollers 140 and 141 are each rotated in the direction of the arrow.

When the developing solution is composed of two solutions, a color developing agent-containing partial solution and an alkaline agent-containing partial solution, an automatic processor having the developing process shown in FIG. 13 is used. FIG. 14 shows an enlarged view of the coating solution supplying portion of the processor shown in FIG. 13. the color developing agent-containing partial solution is supplied onto coating roller 140 through processing solution supplying means 142, and the alkaline agent-containing partial solution is supplied onto the coating roller 141 through another processing solution supplying means 143. The color developing agent-containing partial solution and the alkaline agent-containing partial solution are mixed in the bead 144 formed between the coating rollers 140 and 141. The mixture is supplied through the supplying slit L2 by rotating of the coating rollers 140 and 141 to the image forming surface of the silver halide photographic light-sensitive material P as shown in FIG. 13. Accordingly, the processing time can be shortened.

The mixed solution in the bead is flowed through the supplying outlet L2 and on the coating roller 141, and is coated on the image forming surface P1 of the light-sensitive material P. The contact angle of the coating roller 141 to the processing solution is set within the range of from 5° to 50°. Consequently, the coating layer having a uniformity and an appropriate thickness can be formed on the image forming surface P1 of the light-sensitive material P since the processing solution is made uniform on the coating roller 141.

Experiments were carried out using the above-mentioned automatic processor having the coating roller, in which the material of the coating roller and the contact angle of the coating roller to the processing solution were changed as shown in Table 2. The experiment condition and the results thereof are shown in Table 2.

Receipt of Color Developer

| | |
|---|---|
| Water | 700 ml |
| Sodium sulfite | 0.4 g |
| Pentasodium diethylenetriaminepentaacetate | 3.0 g |
| p-toluenesulfonic acid | 30.0 g |
| Exemplified compound (CD-1) | 15.0 g |
| Disodium di(sulfoethyl)hydroxylamine | 5.0 g |
| Potassium carbonate | 40.0 g |
| Water to make | 1 l |

pH value of the solution was adjusted to 11.5 by sulfuric acid.

The processing time was 15 seconds.

The bleach-fixing process and the stabilizing process was carried out under the condition of CPK-2-J1 process, by Konica Corporation, using the processing solutions for this process. As the silver halide color photographic light-sensitive material, Color Paper QA-A6, manufactured by Konica Corporation, having a width of 300 mm and a length of 420 mm. The color paper was heated by the heat roller. A phenol resin roller coated with Teflon was used as the squeezing roller.

The lower roller was observed after 1 $m^2$ of the light-sensitive material had been processed, and the condition of the roller was evaluated according to the following norm.

The solution supplier having staggeringly arranged multiple holes was used. The solution supplier is a cylindrical form with an external diameter of 20 mm and the hole has a diameter of 0.1 mm. 1440 of the holes were arranged on a line with an interval of 0.2 mm. The supplying amount of the solution was set at 60 ml per 1 $m^2$. The distance L1 was controlled by rotating the solution supplier so as to change the angle of the supplier, and by changing the distance L2 between the paper and the lower end of the solution supplier by varying the height of position of the solution supplier. The solution supplier was rotated in the direction to the lower course of the transportation.

The unevenness of the development was evaluated according to the following norm.

A: No development unevenness was observed.

B: Development unevenness was slightly observed at the edge of the paper.

C: Development unevenness was clearly observed at the edge of the paper.

D: Development unevenness was observed overall the paper.

The stain on the lower roller was evaluated according to the following norm.

A: No stain to be a problem was not observed.

B: Some degree of stain was observed.

C: Apparent stain was formed and the stain was adhered to the paper.

TABLE 2

| Experiment No. | Material of coating roller | Contact angle to Light-sensitive material | Contact angle to Coating roller | Development unevenness | Stain on lower roller | Remarks |
|---|---|---|---|---|---|---|
| 2-1 | Polyethylene | 45° | 70° | C | A | Comparative |
| 2-2 | Teflon | 45° | 82° | C | A–B | Comparative |
| 2-3 | Phenol resin | 45° | 55° | C–B | A | Inventive |
| 2-4 | Phenol resin laminated by Nylon 6 | 45° | 40° | A | A | Inventive |
| 2-5 | Polyvinyl alcohol | 45° | 45° | B | A | Inventive |
| 2-6 | SUS316L | 45° | 30° | A | A | Inventive |
| 2-7 | Phenol resin laminated by polyurethane | 45° | 15° | A | A | Inventive |
| 2-8 | Glass | | 3° | B–C | C | Comparative |

*: Contact angle of the coating roller with the processing solution.

As is shown in Table 2, the prevention of development unevenness is enhance and the stain on the lower roller is not formed when the contact angle of the coating roller with the processing solution is set within the range of 5° to 50°.

Example 3

Experiments were carried out in the same manner as in Experiment 2-5 except that the surfactants relating to the invention were added to the developing solution as shown in Table 3. The evaluation was carried out in the same manner as in Example 3. Results are listed in Table 3.

TABLE 3

| Experiment No. | Kind of surfactant | Adding amount (g/l) | Contact angle to Light-sensitive material | Contact angle to Coating roller | Development unevenness | Stain on lower roller |
|---|---|---|---|---|---|---|
| 3-1 | None | — | 45° | 45° | B | A |
| 3-2 | SII-11 | 0.003 | 43° | 40° | B | A |
| 3-3 | SII-11 | 0.05 | 40° | 35° | A | A |
| 3-4 | SII-11 | 0.2 | 36° | 25° | A | A |
| 3-5 | I-8 | 0.003 | 40° | 38° | A | A |
| 3-6 | I-8 | 0.05 | 37° | 20° | A | A |
| 3-7 | I-8 | 0.2 | 35° | 15° | A | A |
| 3-8 | I-8 | 0.5 | 32° | 10° | A | A–B |
| 3-9 | SI-4 | 0.3 | 42° | 35° | A | A |
| 3-10 | SU-1-2 | 0.5 | 39° | 33° | A | A |

As is shown in Table 3, the prevention of development unevenness is enhance and the stain on the lower roller is not formed when the contact angle of the coating roller with the processing solution is set within the range of 5° to 50° by the use of the surfactant relating to the invention.

Example 4

The experiments were carried out in the same manner as in Experiment 3-5 except that the supplying amount of the processing solution to the coating roller was set as shown in Table 4. The evaluation was carried out in the same manner as in Example 2.

TABLE 3

| Experiment No. | Supplying amount | Development unevenness | Stain on lower roller |
|---|---|---|---|
| 4-1 | 5 ml | C–B | A |
| 4-2 | 10 ml | B | A |
| 4-3 | 30 ml | B–C | A |
| 4-4 | 60 ml | B | A |
| 4-5 | 80 ml | B | A |
| 4-6 | 100 ml | B–C | B |
| 4-7 | 120 ml | C | B |

As is shown in Table 3, the effects of the invention are enhanced by setting the supplying amount of processing solution within the range of 5 ml to 100 ml.

Example 5

Experiments were carried out in the same manner as in Experiment No. 2-5 in Example 2 except that the distance between the solution outlet and the coating roller was set as shown in Table 5. The result of the experiments were evaluated in the same manner as in Example 2. The degree of the formation of precipitate from the processing solution around the solution outlet was evaluated as follows. The results are listed in Table 5.

Evaluation of formation of precipitate around the solution outlet

A: There was no stain around the outlet.

B: A little amount of precipitate was formed at the edge of the outlet. The precipitated can be remove by wiping.

C: Precipitate was formed overall the solution outlet.

TABLE 5

| Experiment No. | Distance* | Development unevenness | Precipitation |
|---|---|---|---|
| 4-1 | 0.1 mm | B–C | A–B |
| 4-2 | 0.2 mm | B | A |
| 4-3 | 1.0 mm | B | A |
| 4-4 | 5.0 mm | B | A |
| 4-5 | 10.0 mm | B–C | A |
| 4-6 | 12.0 mm | B–C | A–B |

*: Distance between the solution supplying outlet and the coating roller.

As is shown in Table 5, the effects of the invention are enhanced by setting the distance between the solution supplying outlet and the coating roller within the range of 0.2 to 10 mm, particularly within the range of 0.2 to 5 mm.

Example 6

Experiments were carried out in the same manner as in Experiment 2-5 except that the flowing distance L1 of the solution on the coating roller was set as shown in Table 6. The evaluation was carried out in the same manner as in Example 2. The degree of the formation of precipitate on the coating roller was evaluated according to the following norm.

Norm of the evaluation of the formation of precipitate on the coating roller

A: Precipitate was almost not formed on the coating roller.

B: Some degree of precipitate formation was observed on the edge of the roller.

C: Formation of precipitate was observed overall the coating roller

TABLE 6

| Experiment No. | L1 | Development unevenness | Precipitate formation on coating roller |
|---|---|---|---|
| 6-1 | 3 mm | C | A |
| 6-2 | 5 mm | C–B | A |
| 6-3 | 10 mm | B | A |
| 6-4 | 20 mm | B | A |
| 6-5 | 30 mm | B | A |
| 6-6 | 50 mm | B | A–B |
| 6-7 | 60 mm | B–C | B |

As is shown in Table 6, the effects of the invention are enhanced by setting LI within the range of 5 to 50 mm.

What is claimed is:

1. A method for processing a silver halide photographic light-sensitive material comprising the steps of:

conveying the silver halide photographic light-sensitive material, which comprises an image forming surface, in a processing apparatus, and applying a photographic processing solution on the image forming surface of the silver halide photographic light-sensitive material in an amount of 5 ml to 100 ml per square meter of the silver halide photographic light-sensitive material, wherein the photographic processing solution contains a developing agent, an alkaline component, a solubilizing agent for developing agent, a preservative and a compound represented by Formula I, whereby the compound represented by Formula I is contained in the photographic processing solution in a sufficient amount so that a contact angle of the processing solution to the image forming surface is not greater than 45°;

$$Rf\text{-}(X)_m\text{-}(Y)_n\text{-}A \qquad \text{Formula I,}$$

wherein

Rf represents a saturated or unsaturated alkyl group having at least one fluorine atom, and X is a sulfonamido group,

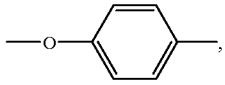

, or

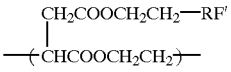

, and

Y is an alkylene oxide group;

RF' represents a saturated or unsaturated alkyl group having at least one fluorine atom;

A represents a hydrophilic group such as $—SO_3M$, $—OSO_3M$, —COOM, $—OPO_3(M_1)(M_2)$ and $—PO_3(M_1)(M_2)$ wherein M, $M_1$, and $M_2$ are each H, Li, K, Na, or $NH_4$;

m represents 0 or 1, and n represents 0 or an integer of 1 to 10.

2. The method of claim 1, wherein said processing solution comprises a first partial solution containing a developing agent and a second partial solution containing an alkaline agent.

3. The method of claim 1, wherein said processing solution has a contact angle to the silver halide photographic material of from 20° to 40°.

4. The method of claim 3, wherein said processing solution is supplied on the image forming surface of said silver halide photographic light-sensitive material in an amount of from 15 ml to 50 ml per square meter of the light-sensitive material.

5. The method of claim 1, wherein said silver halide photographic light-sensitive material is heated to a temperature of not less than 40° C. before applying of the processing solution.

6. The method of claim 1 wherein said processing solution contains a compound represented by Formula I, SI or SII, or a water-soluble organic siloxane compound, $$Rf\text{-}(X)_m\text{-}(Y)_n\text{-}A \qquad \text{Formula I}$$

In the formula, Rf represents a saturated or unsaturated alkyl group having at least one fluorine atom, and X is a sulfonamido group,

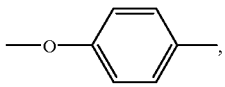

, or

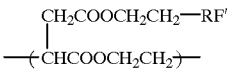

, and Y is an alkylene oxide group, Rf' represents a saturated or unsaturated alkyl group having at least one fluorine atom, A represents a hydrophilic group such as $—SO_3M$, $—OSO_3M$, —COOM, $—OPO_3(M_1)(M_2)$ and $—PO_3(M_1)(M_2)$, M, $M_1$, and $M_2$ are each H, Li, K, Na, or $NH_4$, m represents 0 or 1, and n represents 0 or an integer of 1 to 10;

$$R^1X(E^1)_{l_1}\text{-}(E^2)_{m_1}\text{-}(E^3)_{n_1}R^2 \qquad \text{Formula SI}$$

In the formula, $R^1$ represents a hydrogen atom, an aliphatic group or an acyl group, $R^2$ represents a hydrogen atom, or an aliphatic group, $E^1$ represents an ethylene oxide group, $E^2$ represents a propylene oxide group, and $E^3$ represents an ethylene oxide group, X represents an oxygen atom, or a —$R^3$N— group in which $R^3$ is an aliphatic group, a hydrogen atom or $-(E^1)_{l_2}-(E^2)_{m_2}-(E^3)_{n_2}R^4$, $l_1$, $l_2$, $m_1$, $m_2$, $n_1$, and $n_2$ are each an integer of 0 to 300;

$$A_2—O-(B)_m-(C)_n-X_1 \qquad \text{Formula SII}$$

In the formula, $A_2$ is a mono-valent organic group, and B and C each represent an ethylene oxide group, a propylene oxide group, or $$—(CH_2)_{n1}(\underset{\underset{OH}{|}}{CH})_{m1}(CH_2)_{l_1}O—,$$

in which $n_1$, $m_1$, and $l_1$, represent each 0, 1, 2, or 3, M and n represent each an integer of 0 to 100, $X_1$ is a hydrogen atom, an alkyl group, an aralkyl group, or an aryl group.

7. The method of claim 1, wherein said processing apparatus comprises a processing solution supplying means comprising a coating means for coating said processing solution onto the image forming surface of said silver halide photographic light-sensitive material.

8. The method of claim 7, wherein said coating means comprises a coating head.

9. The method of claim 8, wherein said coating head supplies said processing solution onto the image forming surface of said silver halide photographic light-sensitive material through a gas phase.

10. The method of claim 9, wherein said coating head is an ink-jet head.

11. The method of claim 7, wherein said coating means comprises a roller coater having a coating roller and the processing solution supplying means comprises a processing solution outlet for supplying the processing solution to said coating roller.

12. The method of claim 11, wherein said processing solution has a contact angle to the surface of said coating roller of from 5° to 50°.

13. The method of claim 11, wherein said coating roller comprises a hydrophilic material on the surface thereof.

14. The method of claim 11, wherein the distance from said outlet of the processing supplying means to said coating roller is from 0.2 mm to 10 mm.

15. The method of claim 11, wherein the flowing distance of the processing solution from the outlet of said processing solution supplying means to the image forming surface of the silver halide photographic light-sensitive material is from 5 mm to 50 mm.

16. The method of claim 11, wherein said coating roller is not directly contacted to the image forming surface of said silver halide photographic light-sensitive material.

17. The method of claim 16, wherein a bead of the processing solution is formed between the coating roller and the image forming surface of said silver halide photographic light-sensitive material.

18. The method of claim 11, wherein said coating means further comprises a processing solution removing means for removing the processing solution remaining on the coating roller.

19. The method of claim 1, wherein said silver halide photographic light-sensitive material is subject to further processing steps and wherein the further processing steps commence within a time of not more than 20 seconds after the the processing solution is applied.

20. The method of claim 8, wherein said coating head discharges drops of the processing solution on the photographic light sensitive material.

21. The method of claim 2 wherein both of the first partial solution and the second partial solution comprise the compound represented by Formula I.

22. A method for processing a silver halide photographic light sensitive material comprising the steps of conveying the silver halide photographic light sensitive material, which comprises an image forming surface, in a processing apparatus, and applying a processing solution on the image forming surface of the silver halide photographic light sensitive material in an amount of from 5 ml to 100 ml per square meter of the silver halide photographic light sensitive material, said processing solution comprising a developing agent, wherein the processing apparatus comprises a heating controlling device which comprises a heater, the processing solution contains a compound represented by Formula I in a sufficient amount so that a contact angle of the processing solution to the image forming surface is not greater than 45° and the heating controlling device controls the temperature of the silver halide photographic light sensitive material;

$$Rf-(X)_m(Y)_nA \qquad \text{Formula I}$$

In the formula, Rf represents a saturated or unsaturated alkyl group having at least one fluorine atom, and X is a sulfonamido group,

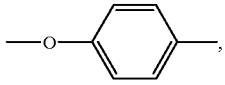

, or $$—(\underset{\underset{CH_2COOCH_2CH_2—RF'}{|}}{CHCOOCH_2CH_2})—,$$

and Y is an alkylene oxide group, Rf" represents a saturated or unsaturated alkyl group having at least one fluorine atom, A represents a hydrophilic group such as $-SO_3M$, $-OSO_3M$, $-COOM$, $-OPO_3(M_1)(M_2)$ and $-PO_3(M_1)(M_2)$, M, $M_1$, and $M_2$ are each H, Li, K, Na, or $NH_4$, m represents 0 or 1, and n represents 0 or an integer of 1 to 10.

* * * * *